US007182446B2

(12) United States Patent
Usui et al.

(10) Patent No.: US 7,182,446 B2
(45) Date of Patent: Feb. 27, 2007

(54) INK CARTRIDGE FOR INK JET RECORDING APPARATUS, CONNECTION UNIT AND INK JET RECORDING APPARATUS

(75) Inventors: Minoru Usui, Nagano (JP); Hisashi Miyazawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/949,277

(22) Filed: Sep. 27, 2004

(65) Prior Publication Data

US 2005/0057626 A1 Mar. 17, 2005

Related U.S. Application Data

(60) Continuation of application No. 10/372,252, filed on Feb. 25, 2003, which is a division of application No. 09/784,349, filed on Feb. 16, 2001, now Pat. No. 6,585,358.

(30) Foreign Application Priority Data

| | | |
|---|---|---|
| Feb. 16, 2000 | (JP) | P.2000-037410 |
| Mar. 27, 2000 | (JP) | P.2000-085791 |
| Mar. 27, 2000 | (JP) | P.2000-085989 |
| Mar. 27, 2000 | (JP) | P.2000-086007 |
| Mar. 30, 2000 | (JP) | P.2000-092802 |
| Jul. 28, 2000 | (JP) | P.2000-228542 |
| Jul. 28, 2000 | (JP) | P.2000-229166 |
| Jul. 28, 2000 | (JP) | P.2000-229167 |

(51) Int. Cl.
*B41J 2/175* (2006.01)

(52) U.S. Cl. ..... 347/86

(58) Field of Classification Search ..... 347/85, 347/86, 87
See application file for complete search history.

(56) References Cited

U.S. PATENT DOCUMENTS

| | | | |
|---|---|---|---|
| 4,183,031 | A | 1/1980 | Kyser et al. |
| 4,419,677 | A | 12/1983 | Kasugayama et al. |
| 4,419,678 | A | 12/1983 | Kasugayama et al. |
| 4,555,719 | A | 11/1985 | Arway et al. |
| 4,558,326 | A | 12/1985 | Kimura et al. |
| 5,025,271 | A | 6/1991 | Baker et al. |
| 5,280,300 | A | 1/1994 | Fong et al. |
| 5,359,357 | A | 10/1994 | Takagi et al. |

(Continued)

FOREIGN PATENT DOCUMENTS

| | | | |
|---|---|---|---|
| CN | 1114530 | C | 7/2003 |

(Continued)

*Primary Examiner*—Anh T. N. Vo
(74) *Attorney, Agent, or Firm*—Sughrue Mion, PLLC

(57) ABSTRACT

An ink cartridge (1) for supplying the ink in an ink reserving chamber (3) via an ink supply port (4) into a recording head (21) has a differential pressure valve mechanism (5) disposed between an ink flow port (7) and the ink supply port (4) in the ink reserving chamber (3), whereby the ink is supplied an adequate amount to the recording head (21) by opening or closing the differential pressure valve mechanism (5) in accordance with an ink pressure of the recording head (21). As a result, it is possible to supply the ink at a substantially constant pressure to the recording head without regard to the variation in the amount of ink or the movement of the carriage.

17 Claims, 33 Drawing Sheets

U.S. PATENT DOCUMENTS

| | | | | | |
|---|---|---|---|---|---|
| 5,426,459 | A | | 6/1995 | Kaplinsky | |
| 5,583,549 | A | | 12/1996 | Ujita et al. | |
| 5,721,576 | A | * | 2/1998 | Barinaga | 347/85 |
| 5,736,992 | A | | 4/1998 | Pawlowski, Jr. | |
| 5,737,001 | A | | 4/1998 | Taylor | |
| 5,777,647 | A | * | 7/1998 | Pawlowski et al. | 347/86 |
| 5,828,389 | A | | 10/1998 | Yamaguchi et al. | |
| 5,847,735 | A | | 12/1998 | Betchon | |
| 5,856,840 | A | | 1/1999 | Barinaga et al. | |
| 5,896,151 | A | | 4/1999 | Miyazawa et al. | |
| 5,912,688 | A | | 6/1999 | Gragg | |
| 5,917,525 | A | | 6/1999 | Butty | |
| 5,992,990 | A | | 11/1999 | Childers et al. | |
| 6,000,788 | A | * | 12/1999 | Iida | 347/86 |
| 6,010,211 | A | | 1/2000 | Betschon | |
| 6,302,531 | B1 | | 10/2001 | Usui et al. | |
| 6,332,481 | B1 | | 12/2001 | Shinada et al. | |
| 6,422,691 | B2 | | 7/2002 | Kobayashi et al. | |
| 6,585,358 | B2 | | 7/2003 | Usui et al. | |
| 2005/0030357 | A1 | | 2/2005 | Sakai et al. | |
| 2006/0098062 | A1 | | 5/2006 | Miyazawa | |

FOREIGN PATENT DOCUMENTS

| | | | |
|---|---|---|---|
| EP | 0 562 717 | A1 | 9/1993 |
| EP | 0 709 207 | A2 | 5/1996 |
| EP | 0 709 207 | A3 | 5/1996 |
| EP | 0 786 351 | A1 | 7/1997 |
| EP | 0 794 059 | A2 | 9/1997 |
| EP | 0 803 363 | A2 | 10/1997 |
| EP | 0 803 364 | A2 | 10/1997 |
| EP | 0 844 094 | A2 | 5/1998 |
| EP | 0 844 094 | A3 | 5/1998 |
| EP | 0 872 355 | A2 | 10/1998 |
| EP | 0 872 355 | A3 | 10/1998 |
| EP | 0 956 965 | A2 | 11/1999 |
| EP | 0 956 965 | A3 | 11/1999 |
| EP | 1 016 533 | | 7/2000 |
| EP | 1 016 533 | A1 | 7/2000 |
| GB | 2323332 | | 9/1998 |
| JP | 05-008404 | A | 1/1993 |
| JP | 5-229137 | | 9/1993 |
| JP | H08-174860 | A | 7/1996 |
| JP | 09-272210 | A | 10/1997 |
| JP | 11-5311 | A | 1/1999 |
| JP | H11-129492 | A | 5/1999 |
| JP | 2001-270129 | A | 10/2001 |
| JP | 2002-103642 | A | 4/2002 |
| WO | WO00/03877 | | 1/2000 |
| WO | WO 00/03877 | A1 | 1/2000 |

* cited by examiner

INK CARTRIDGE FOR INK JET RECORDING APPARATUS, CONNECTION UNIT AND INK JET RECORDING APPARATUS

This is a continuation of application Ser. No. 10/372,252 filed Feb. 25, 2003, which is a divisional of U.S. application Ser. No. 09/784,349 filed Feb. 16, 2001 (having issued on Jul. 1, 2003 as U.S. Pat. No. 6,585,358), the entire disclosures of these prior applications (U.S. application Ser. Nos. 09/784,349 and 10/372,252) are considered part of the disclosure of the present application and are hereby incorporated by reference.

BACKGROUND OF THE INVENTION

Field of the Invention

The present invention relates to an ink supplying system such as an ink cartridge, a connection unit, etc., for supplying ink to an ink jet recording head that ejects ink droplets in response to a print signal. The present invention also relates to a recording apparatus using such an ink supplying system.

In a recording apparatus of the type in which ink is supplied to an ink jet recording head from an ink cartridge that is detachably mounted on a carriage having the recording head thereon, the cartridge is constructed such that the ink is filled in a flexible ink bag and the ink bag is accommodated in a hard case as disclosed, for example, in Europe Patent No. 562717.

Since the ink cartridge thus constructed has no porous member, the ink cartridge can efficiently utilize the container volume of the ink cartridge to accommodate a large quantity of ink, thereby improving the ratio of the ink quantity per the container volume in comparison to an ink cartridge having the ink impregnated in a porous member.

However, since the ink is not held under a capillary force of the porous member, a liquid column of the accommodated ink directly acts on the recording head to change the ink pressure on the recording head depending on a change in quantity of ink.

Further, pressure fluctuation acts on the recording head, which is caused by motion of the ink due to the reciprocal movement of the carriage. Consequently, the print quality is degraded.

SUMMARY OF THE INVENTION

An ink cartridge for an ink-jet recording apparatus, provided according to the present invention, comprises:

a flexible ink bag storing ink therein and having an ink flow port;

a case member storing the ink bag therein;

an ink supply port which supplies ink in the ink bag to a recording head; and a negative pressure generating system which is provided between the ink flow port and the ink supply port, and which maintains pressure of the ink supply port to be lower by a specified valve than pressure in the ink bag.

Another ink cartridge for an ink jet recording apparatus, provided according to the present invention, comprises:

an ink storing chamber;

an atmosphere communicating connection port communicated with the ink storing chamber, and maintaining a closed condition in a first state in which the ink cartridge is not attached on a recording apparatus;

an ink supplying connection port communicated with the ink storing chamber and maintaining a closed condition in the first state; and a negative pressure generating system which supplies ink to the ink supplying connection port while maintaining a predetermined negative pressure state.

Yet another ink cartridge for an ink jet recording apparatus, provided according to the present invention, comprises:

an ink storing chamber;

an atmosphere communicating connection port communicated with the ink storing chamber, and maintaining a closed condition in a first state in which the ink cartridge is not attached to the recording apparatus; and an ink supplying connection port communicated with the ink storing chamber, and maintaining a closed condition in the first state, wherein ink is supplied from the ink cartridge to a recording head via a connection unit that has a negative pressure generating system and that is provided to the recording apparatus.

Accordingly, it is a first object of the invention to provide an ink cartridge that can supply ink to a recording head at a pressure as constant as possible regardless of change in ink quantity and movement of a carriage.

It is a second object of the invention to provide an connection unit that connects an ink cartridge to a recording head and that can supply ink to a recording head at a pressure as constant as possible to a recording head regardless of change in ink quantity and movement of a carriage.

It is a third object of the invention to provide a recording apparatus employing the ink cartridge and/or the connection unit.

The present disclosure relates to the subject matter contained in Japanese patent application Nos.:

2000-37410 (filed on Feb. 16, 2000);

2000-85989 (filed on Mar. 27, 2000);

2000-85791 (filed on Mar. 27, 2000);

2000-86007 (filed on Mar. 27, 2000);

2000-92802 (filed on Mar. 30, 2000);

2000-229167 (filed on Jul. 28, 2000);

2000-228542 (filed on Jul. 28, 2000); and 2000-229166 (filed on Jul. 28, 2000), which are expressly incorporated herein by reference in their entireties.

DESCRIPTION OF THE PREFERRED EMBODIMENT

Figure 1:
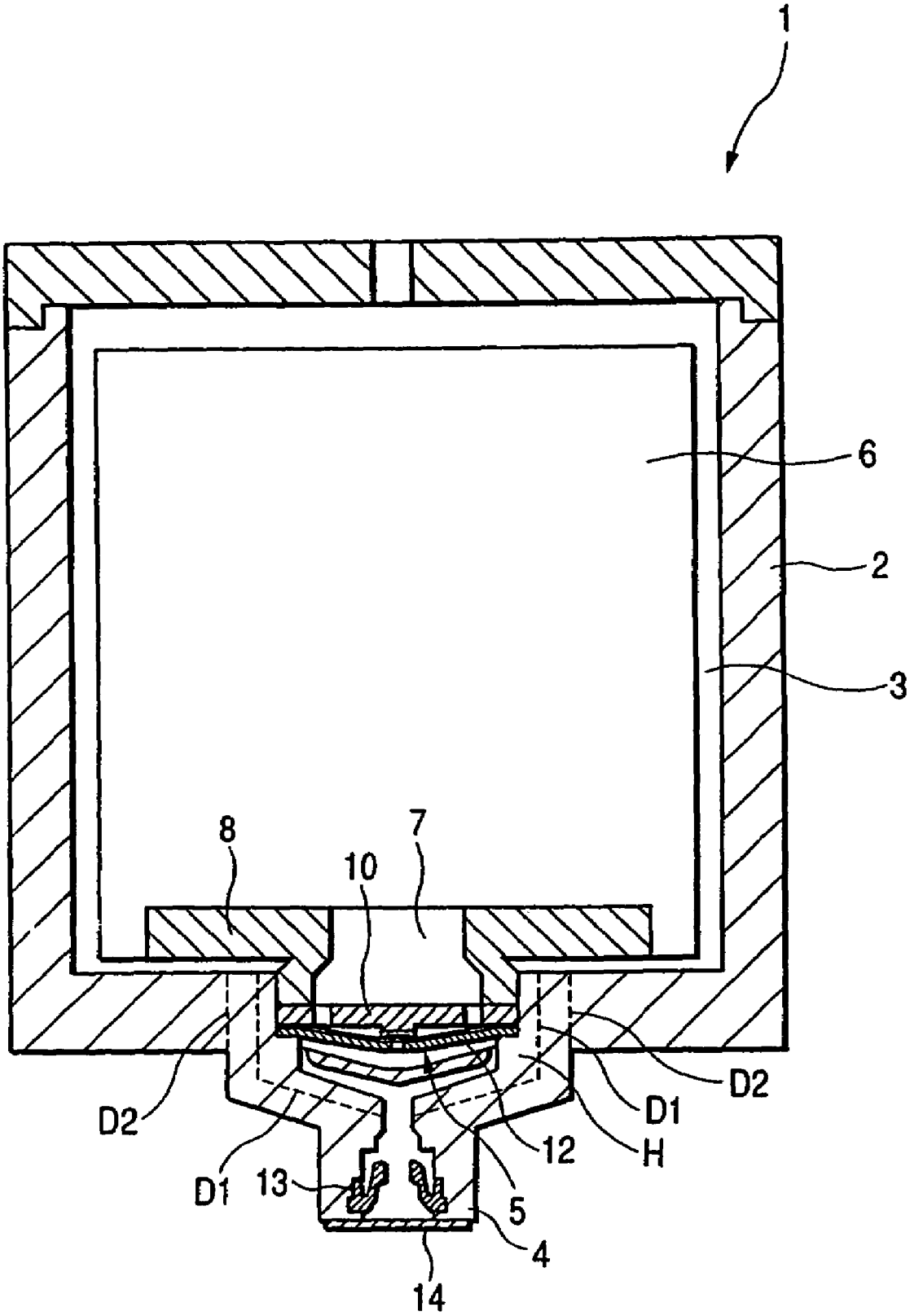
FIG. 1 is a view illustrating one example of an ink cartridge according to the present invention.

FIG. 1 illustrates a first example of an ink cartridge according to the present invention. A hard case 2 constituting the ink cartridge 1 includes an ink storing chamber 3 for storing ink filled in a flexible ink bag 6. The hard case 2 is formed with an ink supply port 4 engageable with an ink supply needle 22 (see FIG. 3) of a carriage at the lower end. Between the ink storing chamber 3 and the ink supply port 4, a differential pressure valve mechanism 5 constituting a negative pressure generating system is arranged such that an ink flow port 7 of the ink bag 6 is communicated via the differential pressure valve mechanism 5 to the ink supply port 4.

The ink bag 6 is formed of an aluminum foil that has an ink proof property in an inner face and that is formed with a high polymer layer. The ink bag 6 is preliminarily bent at both sides thereof to be smoothly flattened depending on the decrease in quantity of ink accommodated therein. The ink bag 6 is sealed by a sealing member 8 having the ink flow port 7. Degassed ink obtained by pressure reduction process is accommodated in the ink bag 9.

Figure 2A:
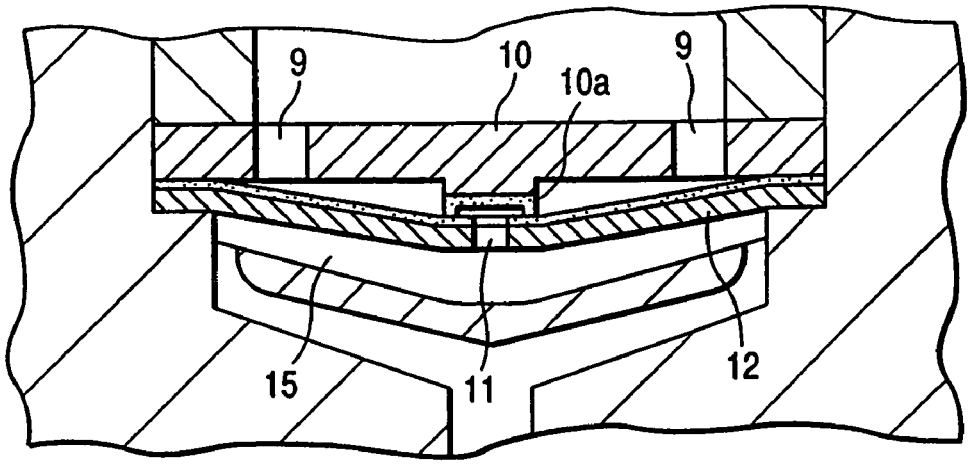
FIGS. 2A and 2B are views illustrating, in enlargement, a closed valve condition and an open valve condition of a differential pressure: valve mechanism constituting a negative pressure generating system of the ink cartridge, respectively.

The differential pressure valve mechanism 5 is constructed such that a valve seat formation member 10 formed with ink flow ports 9 and a valve seat 10*a* are arranged on the upstream side, and a diaphragm valve or a membrane valve 12 formed with a flow port 11 is arranged on the downstream side to be constantly urged toward the valve seat formation member, as shown in FIG. 2A.

Figure 2B:
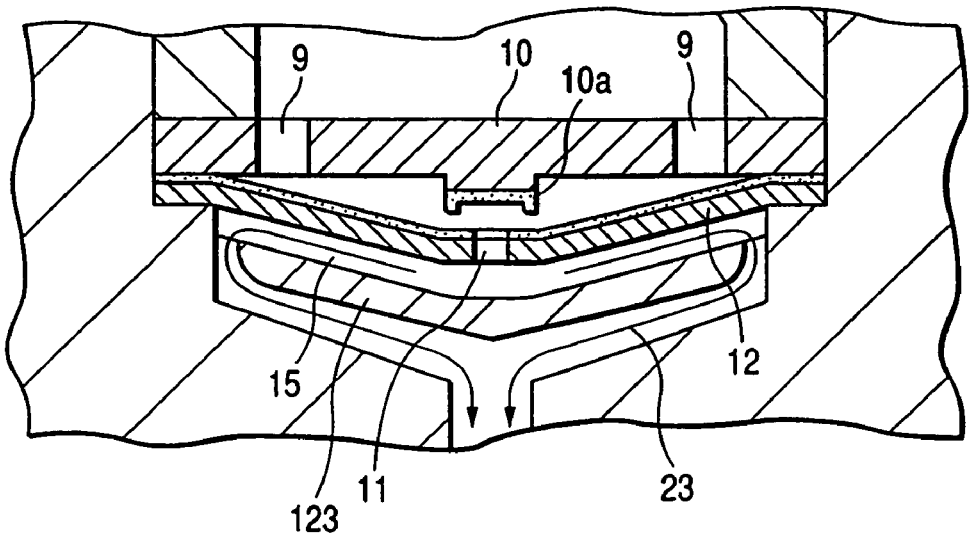

The diaphragm valve 12 has its resiliency adjusted so that if pressure of ink in the ink supply port 4 is decreased to a predetermined value, the diaphragm valve 12 is displaced downward in the figure to be separated from the valve seat formation member 10, thereby opening the ink flow port 11, as shown in FIG. 2B. In FIG. 1, reference numeral 13 denotes a packing member provided at the tip end of the ink supply port 4, and reference numeral 14 denotes a sealing film through which an ink supply needle can be penetrated.

Figure 3:
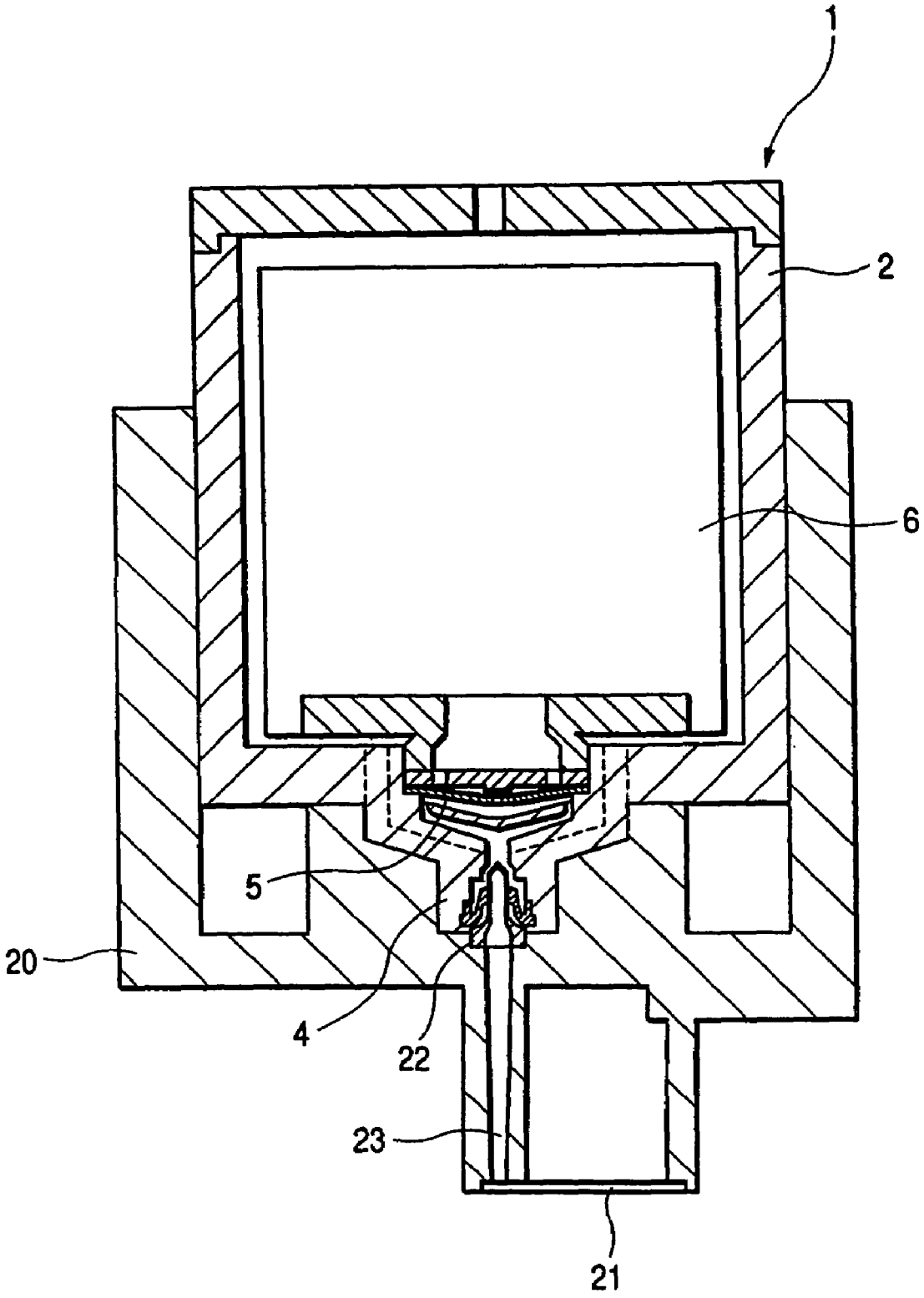
FIG. 3 is a view illustrating a state where the ink cartridge is attached to a carriage.

In this example, the ink supply needle 22 in communication with the recording head 21 mounted on a carriage 20 is inserted into the ink supply port 4 of the ink cartridge 1 as shown in FIG. 3. Subsequently, when the recording head 21 is sealed by a capping system, and a negative pressure is exerted on the recording head 21, the diaphragm valve 12 is separated from the valve seat 10*a* as shown in FIG. 2B so that ink in the ink bag 6 flows through an ink induction passage 23 into the recording head 21.

When the recording head 21 is completely filled with ink in this manner, the negative pressure in the ink supply port 4 is decreased, so that the diaphragm valve 12 comes into contact with the valve seat 10*a*, owing to its resiliency, thereby closing an ink flow passage between the ink bag 6 and the recording head 21, as shown in FIG. 2A.

If the printing is started, the ink is consumed by the recording head 21. In this state, since the ink flow passage between the ink bag 6 and the recording head 21 is closed by the diaphragm valve 12, the recording head 21 is not adversely affected by pressure changes due to the motion of the ink in the ink bag 6 caused by the reciprocal movement of the carriage 20.

If the ink in a valve chamber 15 also serving as an ink reserving portion is consumed in this way and the negative pressure in the ink supply port 4 is increased, the diaphragm valve 12 is moved downward in the figure to be separated from the valve seat 10*a*. As a result, the ink in the ink bag 6 flows into the ink recording head 21. If the ink flows into the valve chamber 15 by an amount corresponding to the ink consumed by recording, the negative pressure in the ink supply port 4 is decreased, so that the diaphragm valve 12 comes into contact with the valve seat 10*a* again.

By repeating the above process, the ink in the ink bag 6 is supplied at appropriate timings into the recording head 21. The amount of ink in the ink bag 6 to be supplied via the diaphragm valve 12 into the recording head 21, i.e. the water head value of ink, does not act directly on the recording head 21. Therefore, the change in ink amount does not vary the print quality.

Thus, the ink in the ink bag 6 is placed in a communicating state with the recording head 21 only during the recording operation. The ink bag 6 is in communication with the atmosphere via the diaphragm valve 12 and the nozzle openings of the recording head 21 during the recording operation, and the ink bag 6 supplies the ink of an amount in conformity with an amount of the ink consumed by the recording head 21, owing to the resiliency of the ink bag 6. On the other hand, because the diaphragm valve 12 is closed in a non-printing state, the ink bag 6 is isolated from the outside air to prevent the ink solvent from evaporating or the atmosphere from entering into the bag 6. Accordingly, the degassed rate of the ink can be maintained for the long time.

If the ink is consumed by recording and the amount of ink in the ink bag 6 is decreased, the ink bag 6 receiving the atmospheric pressure is gradually flattened in accordance with the folding habit until all the ink of the ink bag 6 is supplied to the recording head 21.

Since the ink is sealingly accommodated in the ink bag, the ink solvent in the ink bag is prevented from evaporating, and thus the ink in the ink bag can be used for printing for the longer time in comparison with an ink cartridge which stores ink in a container having an atmosphere communication hole.

In the above example, the diaphragm valve 12 is disposed horizontally, but may be disposed vertically by changing the ink flow passage. In this case, the same effect can be obtained.

In this example, an ink induction passage formation portion 123 defining the ink induction passage 23 is integrally provided to the hard case 2, the sealing member 8 supporting the valve seat formation member 10 is sealingly provided to the ink bag 6 by, for example, thermal welding, and the diaphragm valve 12 is interposed between and held by the valve seat formation member 10 and the part of the hard case 2 located above the ink induction passage formation portion 123 when the ink bag 6 with the valve seat formation member 10 is assembled into the hard case 2. Other than the above-mentioned assembly method, various methods can be adopted to construct the ink cartridge 1 of the present invention. For example, the diaphragm valve 12 may be preliminarily fixed to the valve seat formation member 10, and the ink bag 6 with the sealing member 8, the valve seat formation member 10 and the diaphragm valve 12 may be fixed in place to the hard case 2. Alternatively, as shown by dotted line D1 in FIG. 1, the ink bag 6 may have a hollow cylindrical portion H that is attached to the sealing member 8 and that holds the valve seat formation member 10, the diaphragm valve 12 and the ink induction passage formation portion 123 in cooperation with the sealing member 8, and the ink bag 6 may be fixed to the hard case 2 in such a manner that the hollow portion H is set on an internal recessed portion of the hard case 2 to communicate the ink induction passage 23 with the ink supply port 4. Alternatively, as shown by dotted line D2 in FIG. 1, the ink bag 6 may have the sealing member 8, the valve seat formation member 10, the diaphragm valve 12, the ink induction passage formation portion 123 and the ink supply port 4 as a unit, and the ink bag 6 thus constructed may be fixed to a hole portion of the hard case 2.

Figure 4:
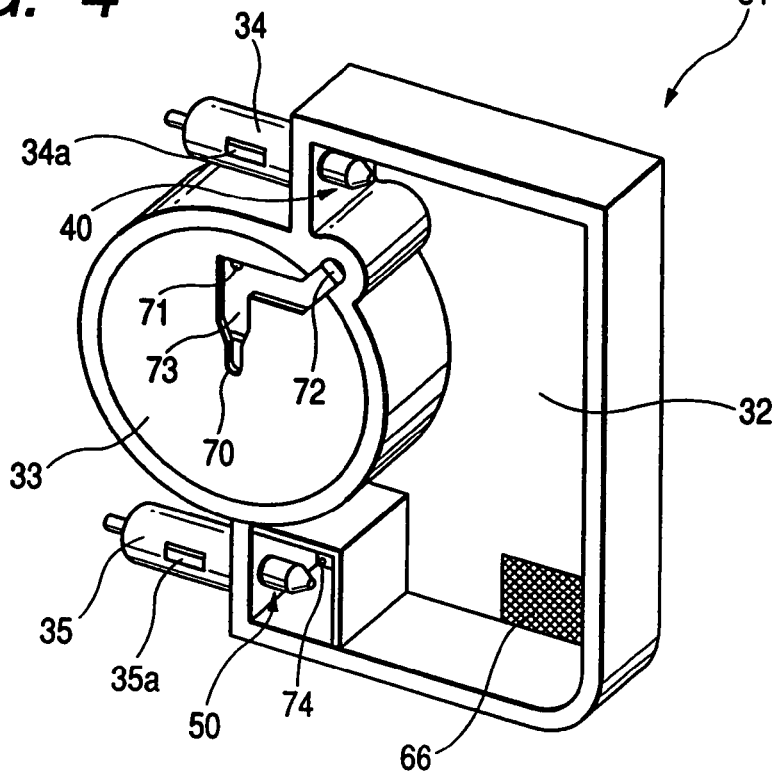
FIG. 4 is a perspective view illustrating one example of the ink cartridge of the invention.
Figure 5:
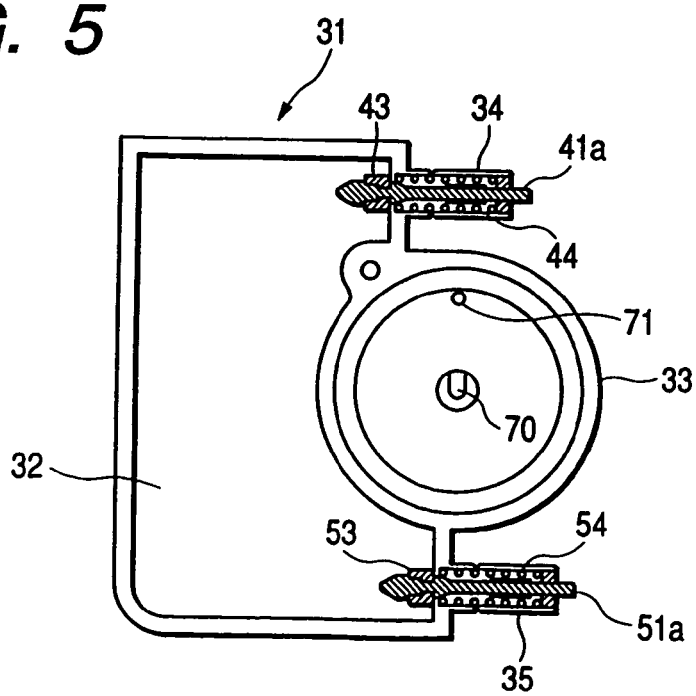
FIG. 5 is a cross-sectional view of the ink cartridge.
Figure 6:
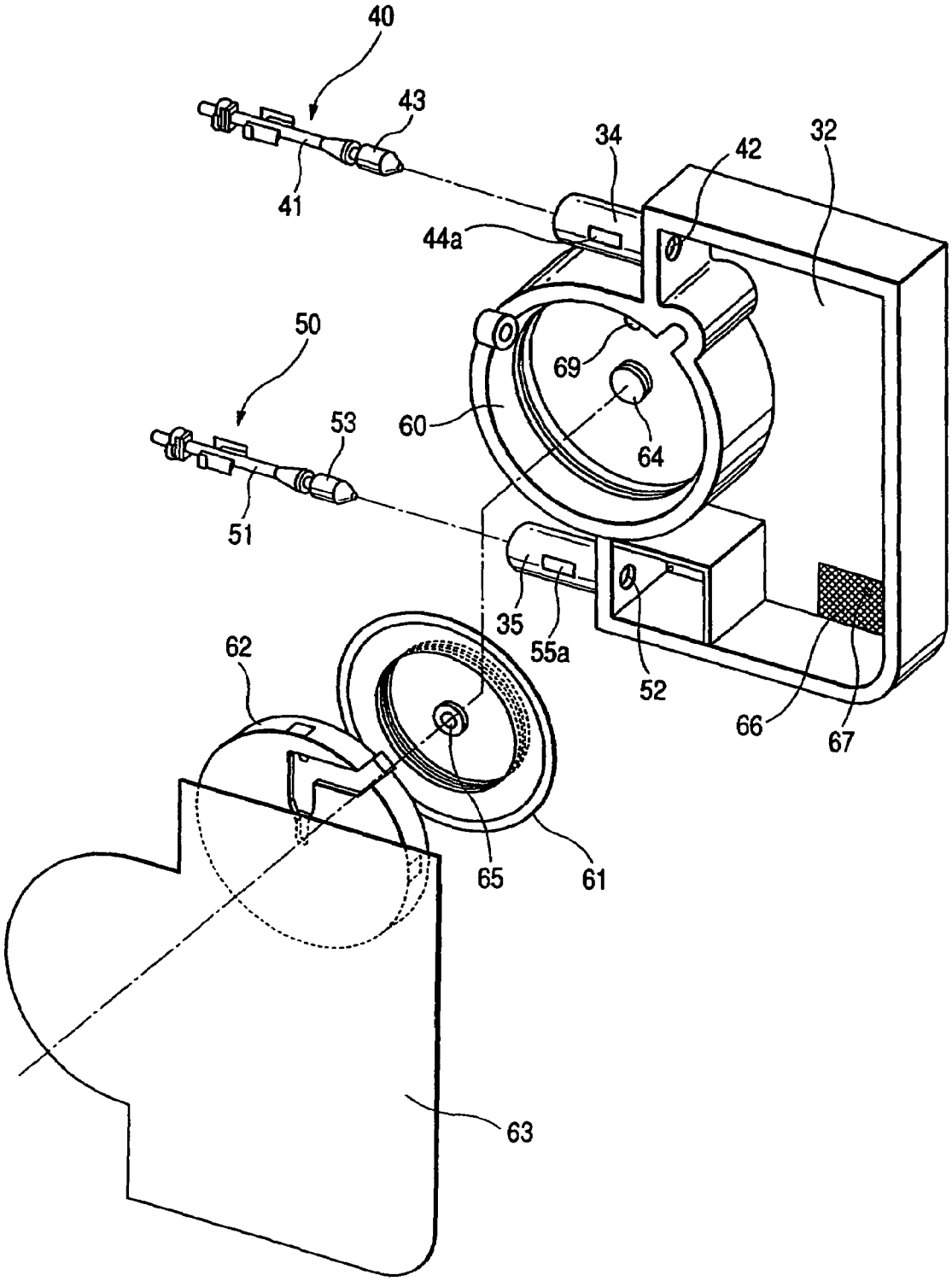
FIG. 6 is an exploded perspective view of the ink cartridge.

FIGS. 4 to 6 illustrate a second example of an ink cartridge of the invention. The ink cartridge 31 is formed with an ink storing chamber 32 extending vertically on one side, and a negative pressure generating system 33 on the other side. The ink cartridge 31 is further formed with an atmosphere communicating connection port 34 and an ink supplying connection port 35 that are respectively located at an upper part and a lower part with respect to the ink storing chamber 32. Each of the ports 34 and 35 is cylindrical in shape to be connected to an external system.

The connection port 34, 35 has a communication window 34*a*, 35*a* on its peripheral face, and accommodates therein an axially movable valve member 40, 50 (see FIG. 6). The valve member 40, 50 includes a slide shaft 41, 51 having one end 41*a*, 51*a* projecting from the connection port 34, 35 in a closed valve condition, and the other end to which a packing 43, 53 made of a resilient material is fitted. The packing 43, 53 is used to seal an opening 42, 52 communicated with the connection port 34, 35. The slide shaft 41, 51 is inserted into the connection port 34, 35 so that the packing 43, 53 is elastically contacted with the opening 42, 53 by the action of a spring 44, 54.

With this constitution, if the ink cartridge 31 is attached to a connection unit 80 (described later), both of the atmosphere communicating connection port 34 and the ink supplying connection port 35 are maintained in an open valve condition in which ink can be supplied to the recording head.

As shown in FIG. 6, the negative pressure generating system 33 is constructed such that a diaphragm valve or membrane valve 61 and a flow passage formation member 62 serving also as a fixing member fixing the outer periphery of the diaphragm valve 61 are accommodated within a valve chamber 60 of a recessed portion that is circular in cross section and that is in communication with the ink storing chamber 32. The region including one side of the negative pressure generating system 33 and one side of the ink storing chamber 32 is sealed with a film 63 having the air impermeable property. The valve chamber 60 is formed with a convex or protruded portion 64 at its center, and the diaphragm valve 61 is formed with a through hole 65 at a position opposed to the convex portion 64.

Figure 7A:
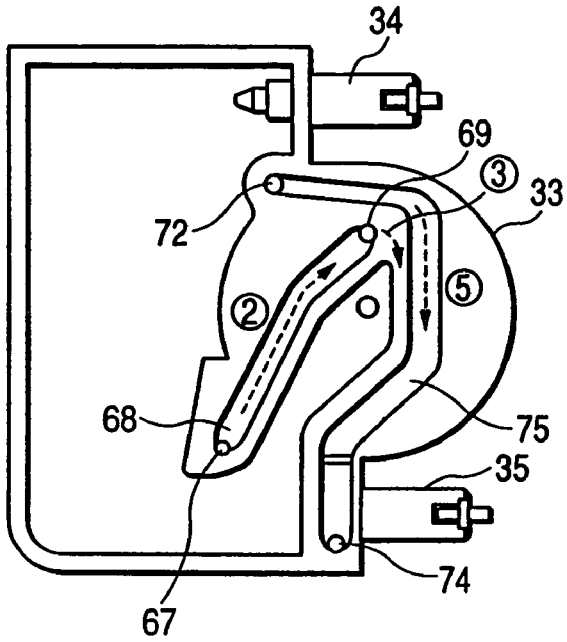
FIGS. 7A and 7B are views illustrating how ink flows in the differential pressure valve mechanism constituting the negative pressure generating system of the ink cartridge.
Figure 7B:
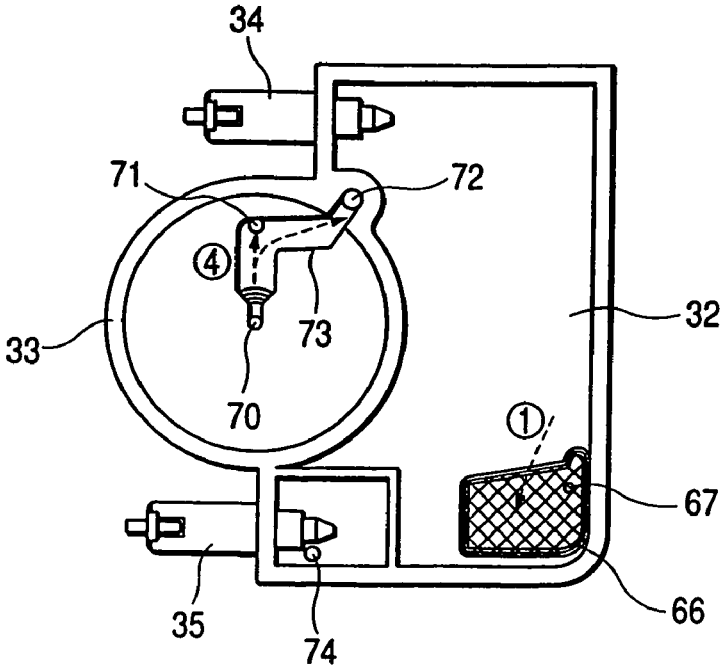

FIGS. 7A and 7B are views illustrating an ink flow passage provided in the negative pressure system 33 at the front side and the back side, respectively. As shown in FIGS. 7A and 7B, and also in FIG. 8, ink in the ink storing chamber 32 is supplied to the ink supplying connection port 35 such that the ink flows from the ink storing chamber 32 to a filter 66 (1), from a passage hole 67 via a flow passage 68 into a passage hole 69 of the valve chamber 60 (2), along the diaphragm valve 61 (3), from the through hole 65 via passage holes 70 and 71 of the valve chamber 60 to a passage hole 72 along a flow passage 73 connecting the passage holes 70, 71 and 72 (4), and from the passage hole 72 to a passage hole 74 communicating with the ink supplying connection port 35 along a flow passage 75 (5).

Figure 8:
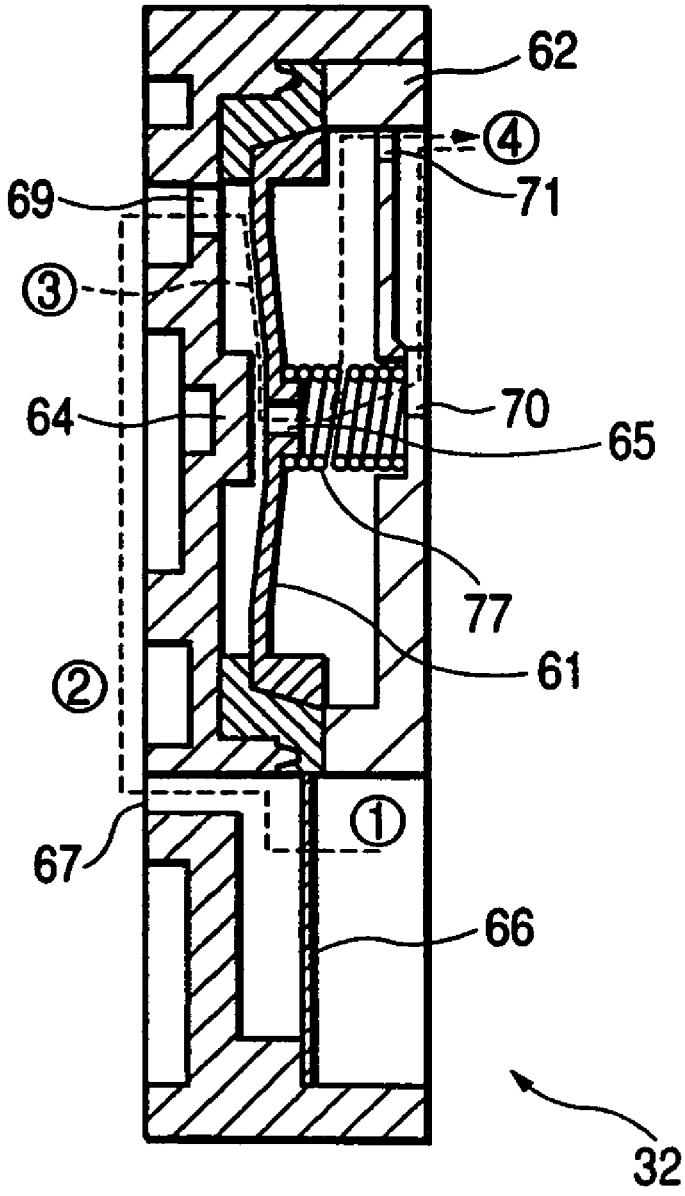
FIG. 8 is a view illustrating a structure in cross section of the differential pressure valve mechanism and how ink flows.

FIG. 8 illustrates a cross-sectional structure of the negative pressure generating system 33, in which the diaphragm valve 61 is formed as a diaphragm having a thick peripheral portion, and the through hole 65 is elastically biased onto the convex portion 64 by a spring 77. The resilient force of the spring 77 is set so that the ink can be supplied depending on the recording operation, while maintaining a negative ink pressure on the recording head.

Figure 9:
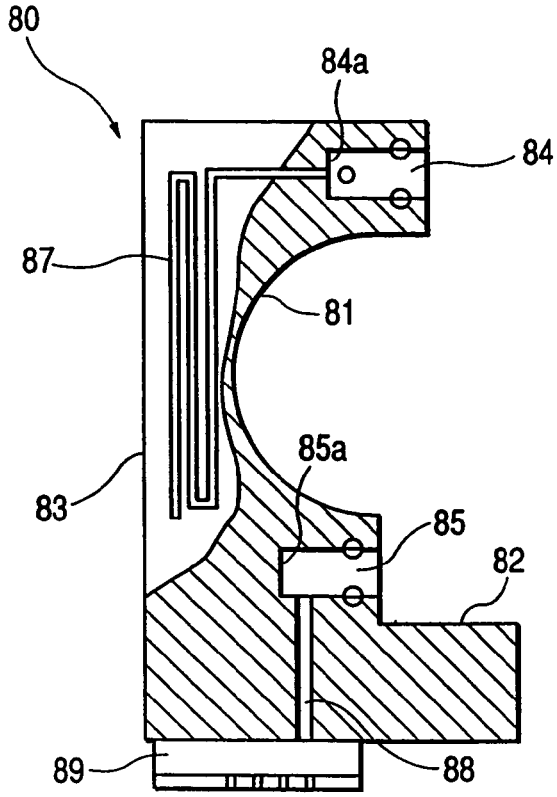
FIG. 9 is a partial cross-sectional view illustrating one example of a connection unit.

FIG. 9 illustrates a first example of a connection unit 80 provided to a main body of the recording apparatus. A main body 83 of the connection unit 80 has walls 81, 82 coincident in shape with a front face and a bottom face of the ink cartridge 31, respectively, and is formed with the recessed portions 84, 85 for receiving the atmosphere communicating connection port 34 and the ink supplying connection port 35 of the ink cartridge 31, and forcing the valve members 40, 50 to be retracted to be open, respectively.

The recessed portion 84 engaging the atmosphere communicating connection port 34 is opened via a capillary 87 formed on the surface of the main body to the atmosphere, and the recessed portion 85 is connected via a communication hole 88 to the recording head 89.

Figure 10:
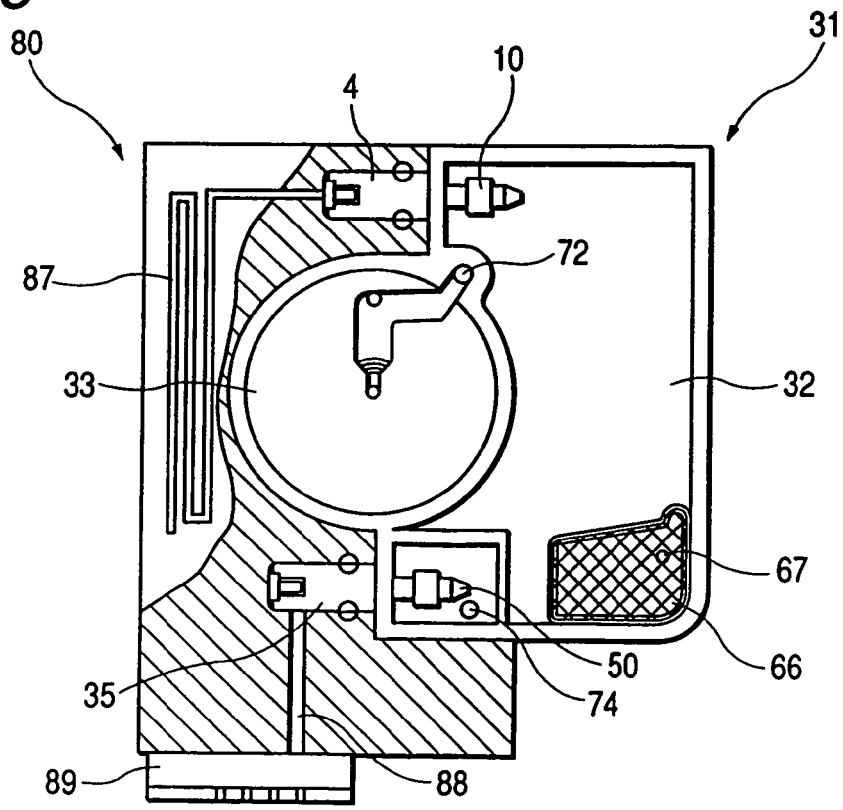
FIG. 10 is a partial cross-sectional view illustrating a state where the ink cartridge is attached to the connection unit.

With such constitution, if the ink cartridge 31 in which ink is filled is attached to the connection unit 80 so that the connection ports 34, 35 are respectively inserted into the recessed portions 84, 85 as shown in FIG. 10, the valve members 40, 50 are respectively pressed by walls 84*a*, 85*a* of the recessed portions 84, 85 to establish the valve open condition. Consequently, the ink storing chamber 32 of the ink cartridge 31 is communicated via the capillary 87 with the atmosphere, so that the ink can be supplied from the ink storing chamber 32 through the communication hole 88 into the recording head 89.

If the ink is consumed by the recording head 89 during printing, and the negative pressure in the ink supplying connection port 35 is increased, the diaphragm valve 61 receiving ink pressure of the ink storing chamber 32 is separated from the protruded portion 64 against a biasing force of the spring 77, because the differential pressure between the front and back sides of the diaphragm valve 61 is increased. Consequently, the through hole 65 of the diaphragm valve 61 is opened, and the passage holes 69 and 72 are communicated with each other, so that the ink flows into the ink supplying connection port 35.

If the ink flows into the recording head 89 to decrease the negative pressure of the ink supplying connection port 35, the diaphragm valve 61 is pressed onto the protruded portion 64 by the biasing force of the spring 77 so that the through hole 65 is sealed by the protruded portion 64. In this way, the diaphragm valve 61 is repeatedly connected with and separated from the protruded portion 64 to maintain the ink pressure of the ink supplying connection port 35 at a constant negative pressure.

If the ink cartridge 31 is removed from the connection unit 80 for the replacement to change print mode or the like, the valve members 40, 50 of the connection ports 34, 35 are released from supports, and are closed by the action of the springs 44, 54, so that the ink storing chamber 32 is shut from the atmosphere. Therefore, even in the state where the ink cartridge 31 is removed from the recording apparatus during the use, it is possible to prevent the ink from leaking or the ink solvent from evaporating, thereby enabling the storage of the ink cartridge for the long time.

In order that a top end 41*a* of the slide shaft 41 in the atmosphere communicating connection port 34 is pressed by the wall of the recessed portion 84 at a relatively earlier timing than a top end 51*a* of the slide shaft 51 in the ink supplying end connection 35 is pressed by the wall of the recessed portion 85, it is preferable that the protruded length of the top end 41*a* is set longer than the protruded length of the top end 51*a* or a projection is formed on the wall 84*a*. This makes it possible to avoid any inconveniences caused due to a difference in pressure between the ink chamber and the atmosphere, namely, the leakage of the ink or the suction of the atmosphere via the recording head 89.

Figure 11:
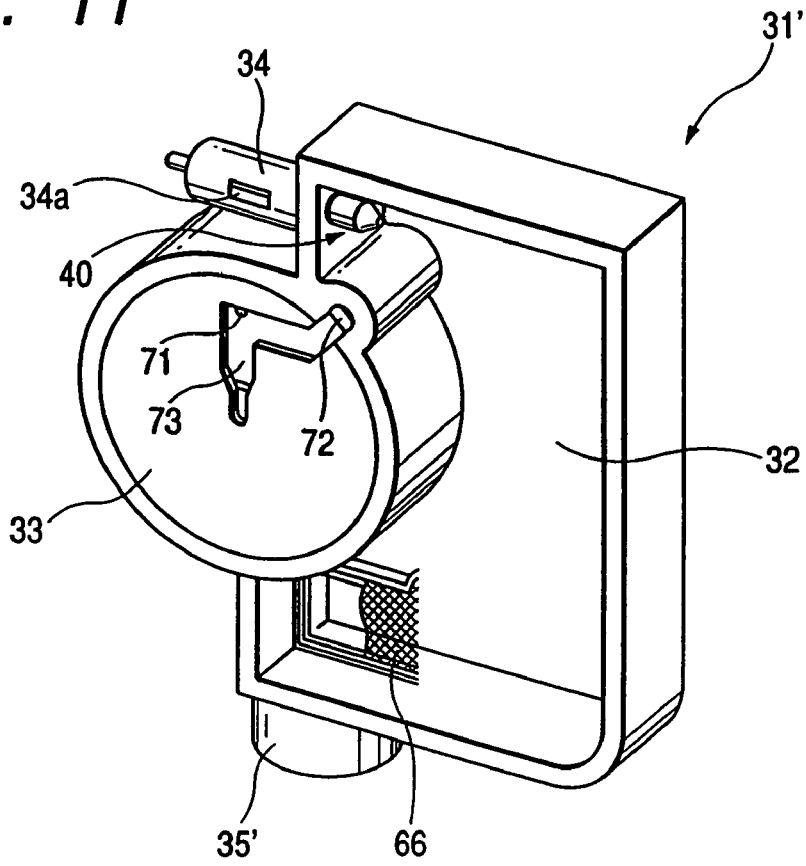
FIG. 11 is a view illustrating one example of the ink cartridge of the invention.
Figure 12:
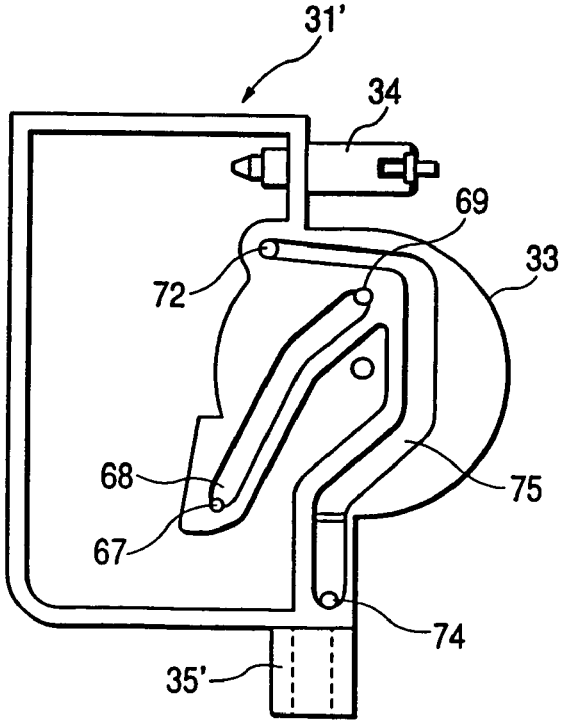
FIG. 12 is a cross-sectional view of the one example of the ink cartridge.

FIGS. 11 and 12 illustrate a third example of the ink cartridge 31 of the invention, in which the ink supplying connection port 35' is formed as a simple open port. In this example, until an ink cartridge 31' is attached to a connection unit 80', the valve member 40 of the atmosphere communicating connection port 34 keeps a closed valve condition with the aid of the biasing force of the spring 44, and the diaphragm valve 61 of the negative pressure system 33 also keeps a closed valve condition. Therefore, the ink in the ink storing chamber 32 does not leak through the ink supplying connection port 35'.

Figure 13:
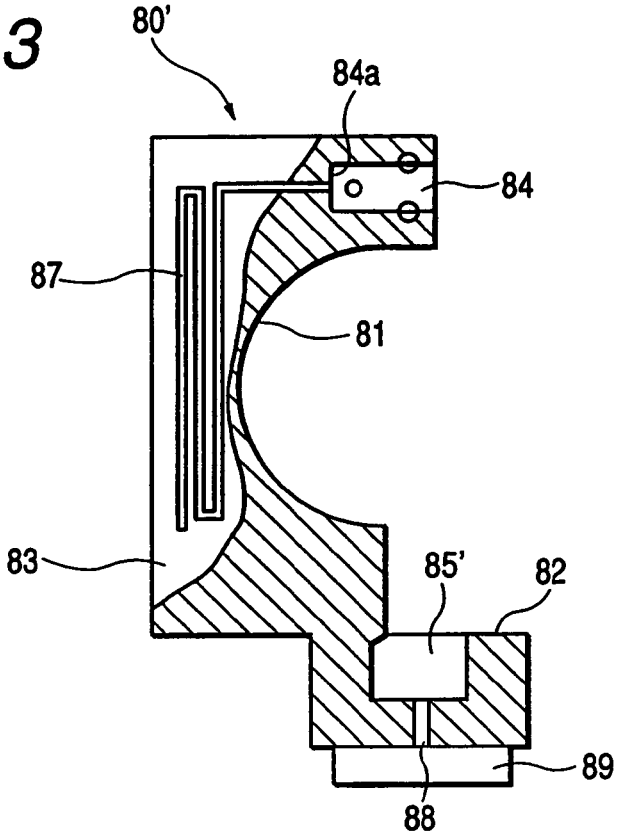
FIG. 13 is a partial cross-sectional view illustrating one example of a connection unit that is suitable for the ink cartridge.
Figure 14:
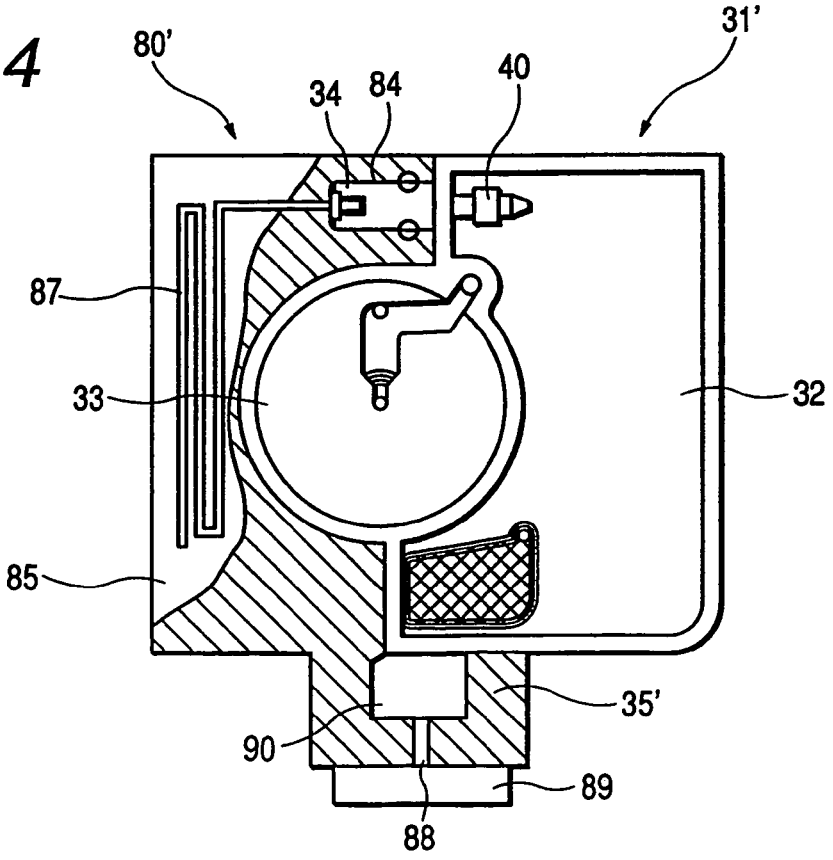
FIG. 14 is a partial cross-sectional view illustrating a state where the ink cartridge is attached to the connection unit.

The mating connection unit 80' is formed with a recessed portion 85' having the communicating hole 88 communicating with the recording head 89, as shown in FIG. 13. If the ink cartridge 31' is attached, the valve member 40 is pressed by the wall 84*a* of the recessed portion 84 to establish the open valve condition. Consequently, the ink storing chamber 32 of the ink cartridge 31' is communicated via the capillary 87 to the atmosphere, so that the ink in the ink storing chamber 32 can be supplied through the communication hole 88 into the recording head 89.

In this example, since the ink storing chamber 32 is also shut out from the atmosphere by the valve member 40 of the connection port 34 and the negative pressure generating system 33, it is possible to prevent the ink from leaking or the ink solvent from evaporating, even if the ink cartridge 31' is removed from the recording apparatus during the use, thereby enabling the storage of the ink cartridge for the long time. In addition, it is preferable to seal the ink supplying connection port 35' with a cap or the like in order to prevent ink adhered to the vicinity of the ink supplying connection port 35' from-being dried.

Figure 15:
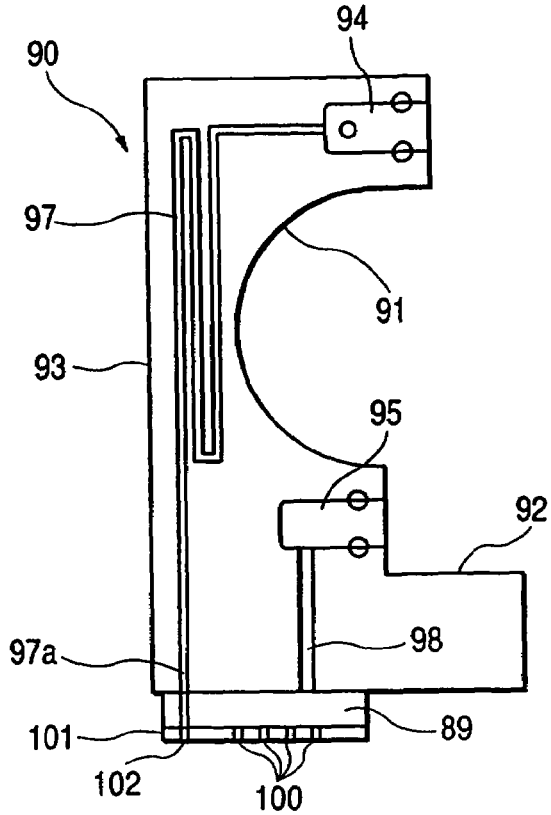
FIG. 15 is a view illustrating one example of a connection unit for connecting the ink cartridge and a recording head.

FIG. 15 illustrates a third example of a connection unit 90 adapted to the ink cartridge 31. A main body 93 of the connection unit 90 has walls 91, 92 coincident in shape with a front face and a bottom face of the ink cartridge 31, respectively, and is formed with the recessed portions 94, 95 for receiving the atmosphere communicating connection port 34 and the ink supplying connection port 35 of the ink cartridge 31, and forcing the valve members 40, 50 to be retracted to be open, respectively.

The recessed portion 94 engaging the atmosphere communicating connection port 34 is communicated via a capillary 97 formed on the surface of the main body with the recording head 89. That is, in this example, an atmosphere communication passage defined by the connection port 34 and the capillary 97 is opened at a surface of the recording head 89. The recessed portion 95 is communicated via a communication hole 98 with the recording head 89.

The recording head 89 receives the ink supply from the ink cartridge 31, and includes nozzle openings 100 from which ink pressurized by a pressure generating system is ejected as liquid droplets, and an atmosphere communicating port 102 communicated with an end portion 97*a* of the capillary 97.

Figure 16:
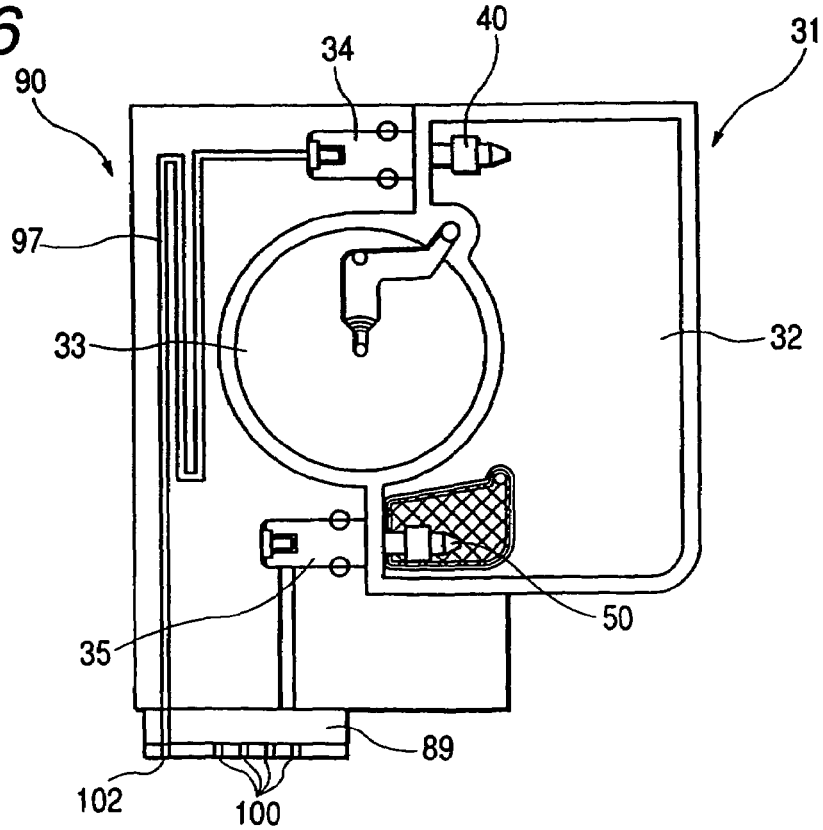
FIG. 16 is a view illustrating a state where the ink cartridge is attached to the connection unit.

With such constitution, if the ink cartridge storing ink therein is mounted so that the connection ports 34, 35 are inserted into the recessed portions 94, 95 of the connection unit 90, the valve members 40, 50 are pressed by the walls of the recessed portions 94, 95, respectively, as shown in FIG. 16, to establish the open valve condition in which the ink can be supplied from the ink storing chamber 32 into the recording head 89.

Figure 17A:
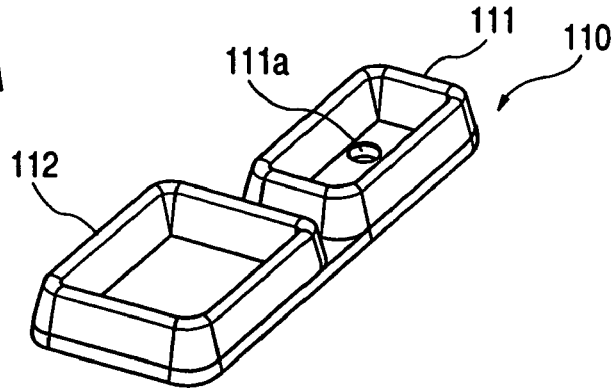
FIGS. 17A and 17B are views illustrating one example of a capping system.
Figure 17B:
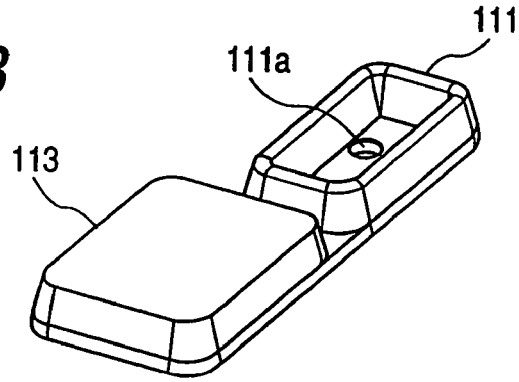

FIG. 17A illustrates one example of a capping mechanism 110, including a first cap 111 and a second cap 112. The first cap 111 is designed to selectively seal a region of the recording head 89 where the nozzle openings 100 are formed. The first cap 111 is communicated with an unillustrated ink suction pump via an opening 111*a*. The second cap 112 is designed to seal both the nozzle openings 100 and the atmosphere communicating port 102. The second cap 112 in this example, is formed with a recessed portion for defining a sealed space when the second cap 112 is contacted with the recording head 89, but the second cap 112 may be configured as a protruded base having a planar surface (113) that can be elastically contacted with the surface of a nozzle plate 101 to seal the nozzle openings 100 and the atmosphere communicating port 102 as shown in FIG. 17B. In this case also, the same effect can be obtained, as in the case of FIG. 17A.

Figure 18A:
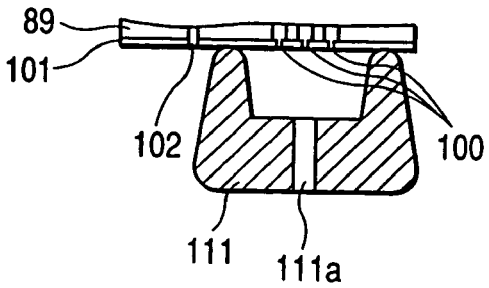
FIGS. 18A and 18B are views illustrating a capped state when ink is sucked, and a rest state, respectively.

As shown in FIG. 18A, if the-first cap 111 of the capping system 110 seals the recording head 89 to apply a negative pressure to the recording head 89, a strong negative pressure acts on the ink supplying connection port 35 via the recording head 89 to open the diaphragm valve 61. Consequently, the ink in the ink storing chamber 32 flows into the recording head 89 so that the recording head 89 is filled with the ink.

In the case where a print failure occurs due to clogging of the nozzle openings 100 during the recording operation, if the recording head 89 is sealed by the first cap 101 and a negative pressure is applied to the recording head 89, in the same way as filling the ink into the cartridge as shown in FIG. 18A, the ink is forcibly discharged through the nozzle openings 100 of the recording head 89, thereby resolving the clogging.

Figure 18B:
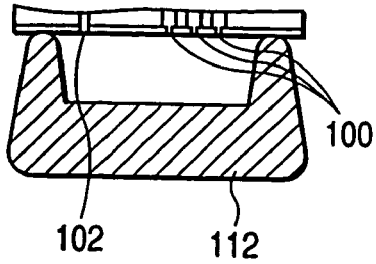

In the case where the print operation is ended, the recording head 89 is moved to the second cap 112 of the capping system 110 and sealed thereby, the nozzle openings 100 and the atmosphere communicating port 102 are both sealed as shown in FIG. 18B. Therefore, even if the ink cartridge 31 is inclined when the recording apparatus is moved, and the ink arrives at the atmosphere communicating connection port 34 and leaks through the atmosphere communicating port 102, the ink can be received into the cap 112, and prevented from leaking out of the recording apparatus.

Figure 19A:
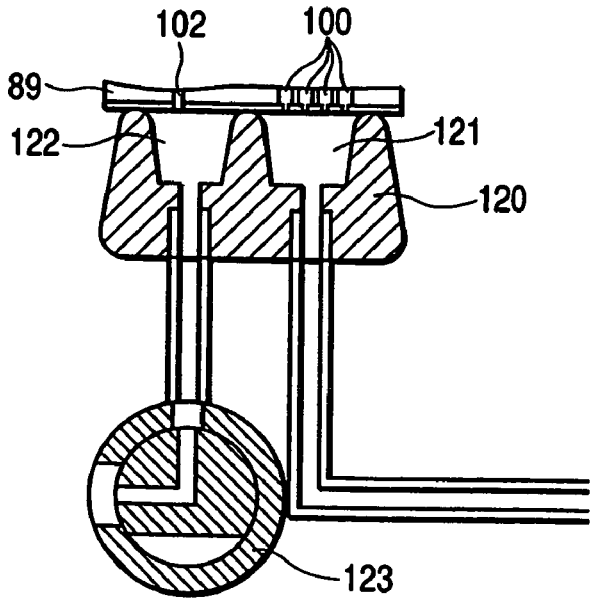
FIGS. 19A and 19B are views illustrating one example of a capping system in a state where the ink is sucked and in a rest state, respectively.
Figure 19B:
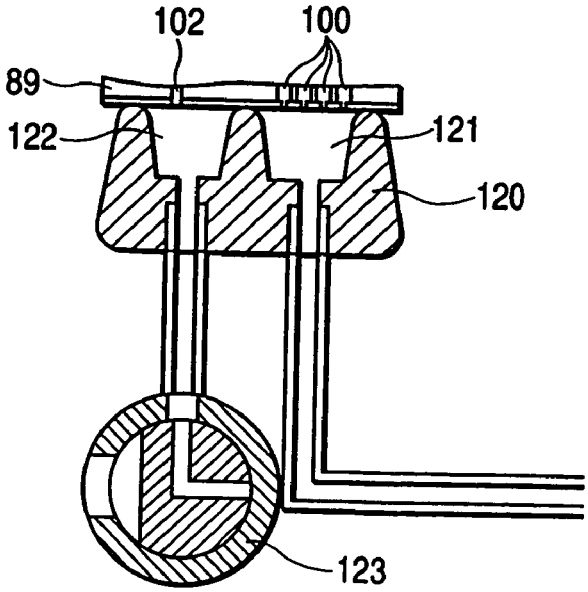

In the above example, separate caps are employed to seal a region where the nozzle openings 100 of the recording head 89 are formed and a region where the nozzle openings 100 and the atmosphere communicating port 102 are formed. However, as shown in FIGS. 19*a* and 19B, the same cap 120 may be formed with a recessed portion 121 for sealing the region where the nozzle openings 100 are formed and a recessed portion 122 for sealing the atmosphere communicating port 102. In this case, a switch valve can be employed to communicate the recessed portion 121 with a suction pump, and the recessed portion 122 with the atmosphere, or to shut the recessed portion 122 from the atmosphere at the rest time, as shown in FIG. 19B, thereby exhibiting the same effect. In the example shown in FIGS. 19A and 19B, only one switch valve 123 is provided to selectively communicate the recessed portion 122 with the atmosphere and isolate the recessed portion 122 from the atmosphere, and the recessed portion 121 is maintained in communication with the suction pump. However, another switch valve may be provided between the recessed portion 121 and the suction pump.

Figure 20:
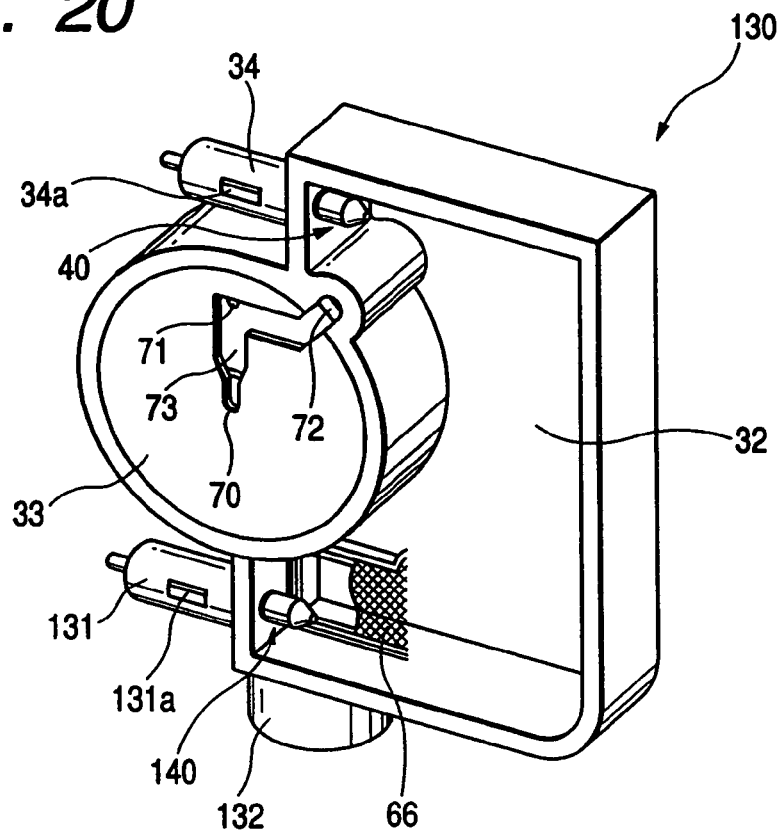
FIG. 20 is a perspective view illustrating one example of an ink cartridge according to the invention.
Figure 21:
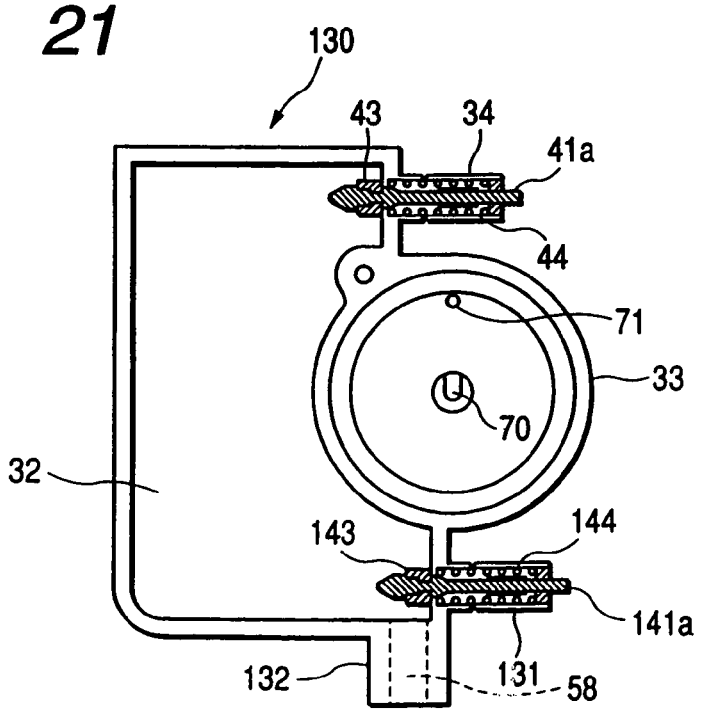
FIG. 21 is a cross-sectional view illustrating the one example of the ink cartridge.
Figure 22:
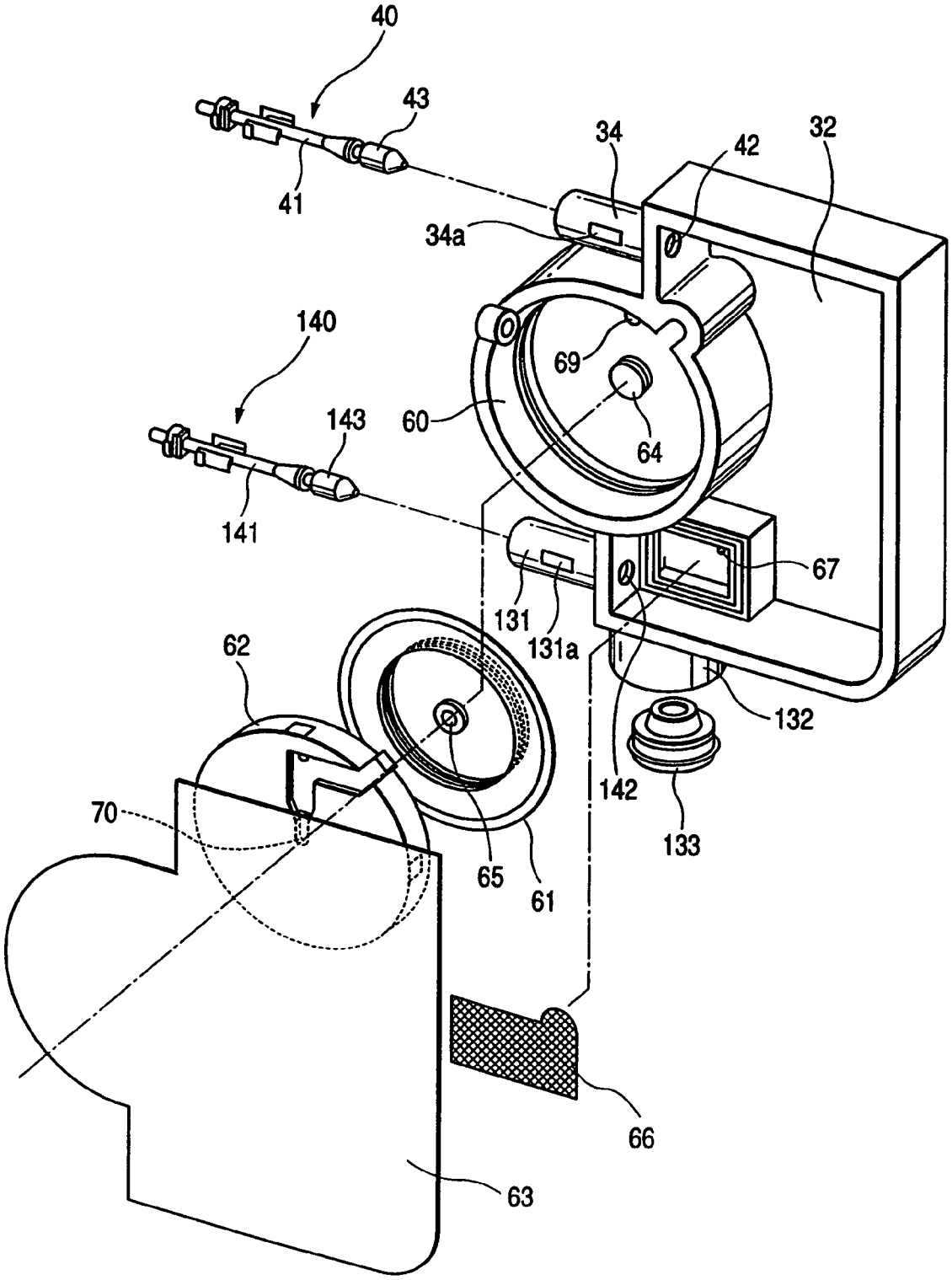
FIG. 22 is an exploded perspective view of the one example of the ink cartridge.

FIGS. 20, 21 and 22 illustrate a fourth example of the ink cartridge of the invention, in which the same structure is adopted as in the previous examples, except that an ink injecting connection port and an ink flow port for supplying ink to the recording head are formed.

That is, this ink cartridge 130 is formed with the ink storing chamber 32 extending vertically on one side, and the negative pressure generating system 33 on the other side. The atmosphere communicating connection port 34 and an ink injecting connection port 131 are arranged at an upper part and a lower part with respect to the ink storing chamber 32. Each of the ports 34 and 131 is constructed by a cylindrical member that is connected to an external system. An ink flow port 132 for supplying the ink to the recording head is formed at the lower most portion.

Each of the atmosphere communicating connection port 34 and the ink injecting connection port 131 has a communication window 34*a*, 131*a* on its peripheral face, and accommodates an axially movable valve member 40, 140 therein. Each of the valve members 40, 140 includes a slide shaft 41, 141 having one end 41*a*, 141*a* projecting from the connection port 34, 131 in a closed valve condition, and the other end to which a packing 43, 143 made of a resilient material is fitted for sealing an opening 42, 142 communicated with the connection port 34, 131. The slide shaft 41, 141 is inserted into the connection port 34, 131 in such a manner that the packing 43, 143 is elastically contacted with the opening 42, 142 by the action of a spring 44, 144.

With this constitution, if the ink cartridge 130 is attached to a connection unit, the atmosphere communicating connection port 34 is maintained in an open valve condition. However, the ink injecting connection port 131 is maintained in a closed valve condition, and opened only when an ink injector is inserted (described later).

Similarly to the aforementioned examples, the negative pressure generating system 33 is constructed, as shown in FIG. 22, such that the diaphragm valve 61 and the flow passage formation member 62 serving as a fixing member for fixing the outer periphery of the diaphragm valve 61 are accommodated within the valve chamber 60 formed into the recessed portion that is circular in cross section, and that is in communication with the ink storing chamber 32. The region including one side of the negative pressure generating system 33 and one side of the ink storing chamber 32 is sealed by the film 63 having the air impermeable property. The valve chamber 60 is formed with the convex or protruded portion 64 at its center, and the diaphragm valve 61 is formed with the through hole 65 at a position corresponding to the protruded portion 64.

Figure 23A:
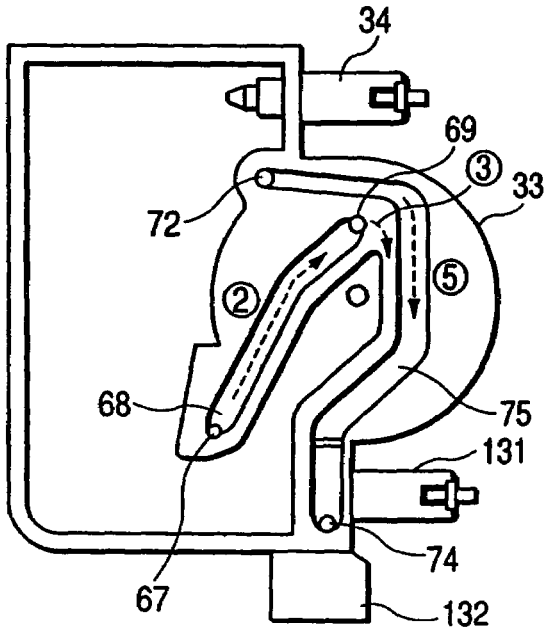
FIGS. 23A and 23B are views illustrating how ink flows in a negative pressure generating system of the ink cartridge, respectively.
Figure 23B:
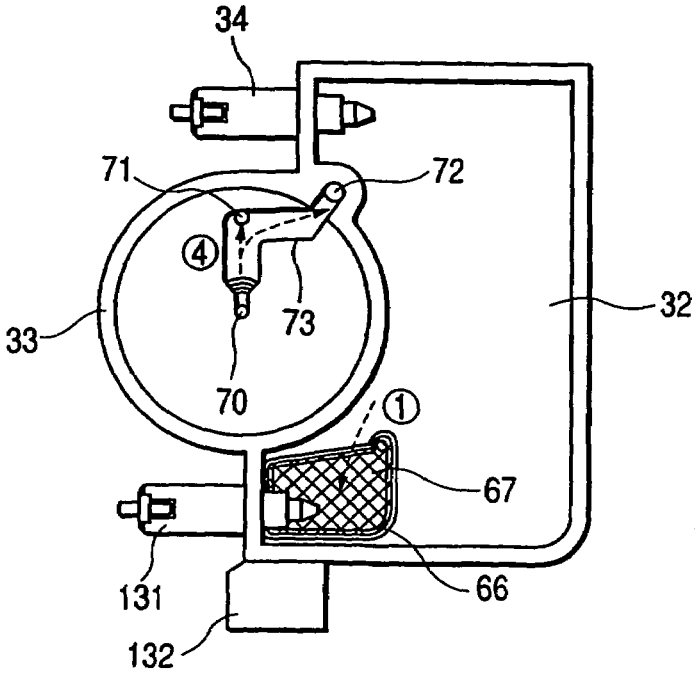

FIGS. 23A and 23B are views illustrating the ink flow passage provided in the negative pressure generating system 33 at the front side and the back side, respectively. Similarly to the aforementioned examples, ink flows from the ink storing chamber 32 to the filter 66 (1), from the passage-hole 67 via the flow passage 68 into the passage hole 69 of the valve chamber 60 (2), along the diaphragm valve 61 (3), from the passage holes 70 and 71 of the valve chamber 60 to the passage hole 72 along the flow passage 73 connecting the passage holes 70, 71 and 72 (4), and from the passage hole 72 through the flow passage 75 to the passage hole 74 communicating with the ink flow port 132 (5). Reference numeral 133 denotes a packing that is fitted into the ink flow port 132.

Figure 24A:
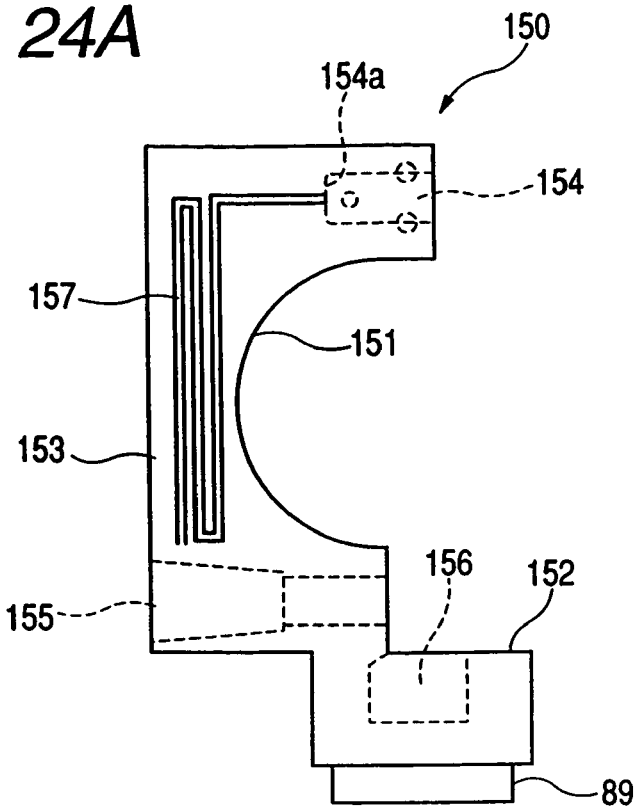
FIGS. 24A and 24B are a front view and a cross-sectional view illustrating one example of the connection unit, respectively.
Figure 24B:
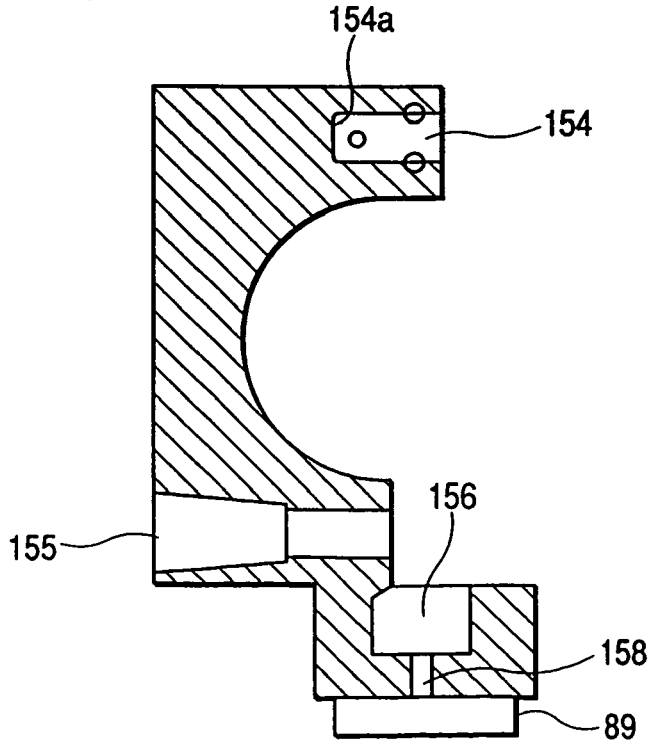

FIG. 24 illustrates a fourth example of the connection unit. A main body 153 of the connection unit 150 has the walls 151, 152 in conformity in shape with a front face and a bottom face of the ink cartridge, respectively. The main body 153 and is formed with a recessed portion 154, a through hole 155 and a recessed portion 156 which respectively receive the atmosphere communicating connection port 34, the ink injecting connection port 131, and the ink flow port 132 of the ink cartridge 130.

The recessed portion 154 engaging the atmosphere communicating connection port 34 is opened via a capillary 157 formed on the surface of the main body to the atmosphere, and is internally formed with a wall 154*a* for pressing the valve member 40 of the atmosphere communicating connection port 34.

The through hole 155 for receiving the ink injecting connection 131 port does not have such a wall as to contact the valve member 140 of the ink cartridge 130, and accordingly, the ink injecting connection port 131 is maintained at a closed valve condition even if the ink cartridge 130 is attached to the connection unit 150. The recessed portion 156 connected to the ink flow port 132 is communicated with the recording head 89 via a communication hole 158.

Figure 25A:
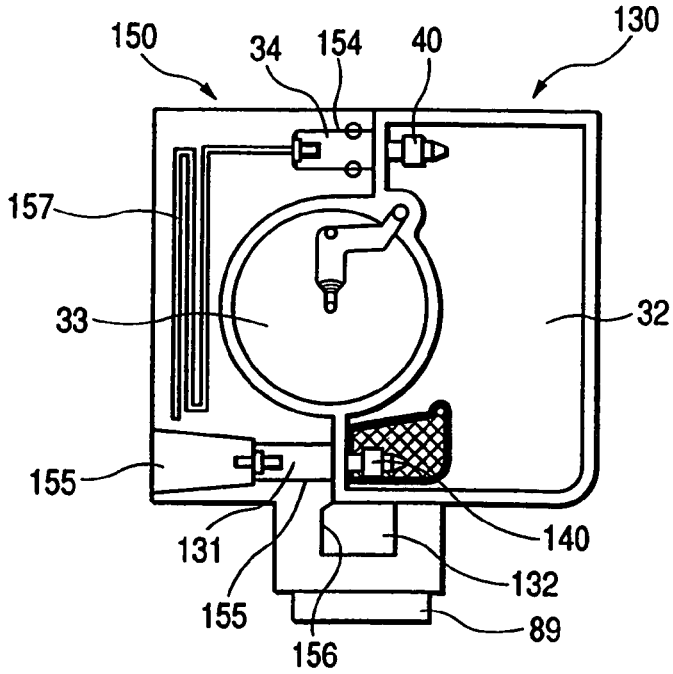
FIGS. 25A, 25B and 25C are views illustrating a state where the ink cartridge is attached to the connection unit, an ink injecting process, and a structure of the tip end of a syringe, respectively.

With such constitution, the ink cartridge 130 storing the ink therein is connected to the connection unit 130 such that the ink flow port 132 is positioned with respect to the recessed portion 156, and then the upper part of the cartridge 130 is pivoted toward the connection unit 130, as shown in FIG. 25A.

Since the diaphragm valve 61 keeps a closed valve condition, until the ink cartridge 130 is attached to the connection unit 150, the ink in the ink storing chamber 32 does not leak through the ink flow port 132. Also, since the valve member 40 of the atmosphere communicating connection port 34 keeps a closed valve condition, the ink in the ink storing chamber 32 does not evaporate.

In the connected state, the slide shaft 41 of the atmosphere communicating connection port 34 in the ink cartridge 130 is pressed by the wall and retracted against the biasing force of the spring, so that the valve is opened. Consequently, the ink storing chamber 32 is communicated via the capillary 157 to the atmosphere. The valve member 20 of the ink injecting connection port 131 maintains a closed valve condition to prevent the leakage of the ink, and the entry of the atmosphere.

In this state, if the recording head 89 is sealed by the capping system and a negative pressure is applied to the recording head 89, the ink flow port 132 is subjected to a strong negative pressure to force the diaphragm valve 12 in the negative pressure generating system 33 to be opened. Consequently, the ink in the ink storing chamber 32 flows into the recording head 89, and the recording head 89 is filled with the ink.

If the ink is consumed by the recording head 89 to cause the negative pressure of the ink flow port 132 to be increased, the ink is supplied to the recording head 89 in the same way as in the previous examples.

That is, the diaphragm valve 61 receiving the ink pressure of the ink storing-chamber 32 is separated from the protruded portion 64 against the biasing force of the spring 77, because the difference in pressure between the front and back sides of the diaphragm valve 61 is increased. Consequently, the through hole 65 of the diaphragm valve 61 is opened and the passage holes 69 and 72 are communicated with each other to permit the ink to flow into the ink flow port 132. If the ink flows into the recording head 89 and the negative pressure of the ink flow port 132 is decreased, the diaphragm valve 61 is pressed onto the protruded portion 64 by the action of the biasing force of the spring 77 so that the through hole 65 is sealed with the protruded portion 64. In this way, the diaphragm valve 61 is repeatedly contacted with and separated from the protruded portion 64 so as to keep the ink pressure of the ink flow port 132 at a constant negative pressure.

Figure 25B:
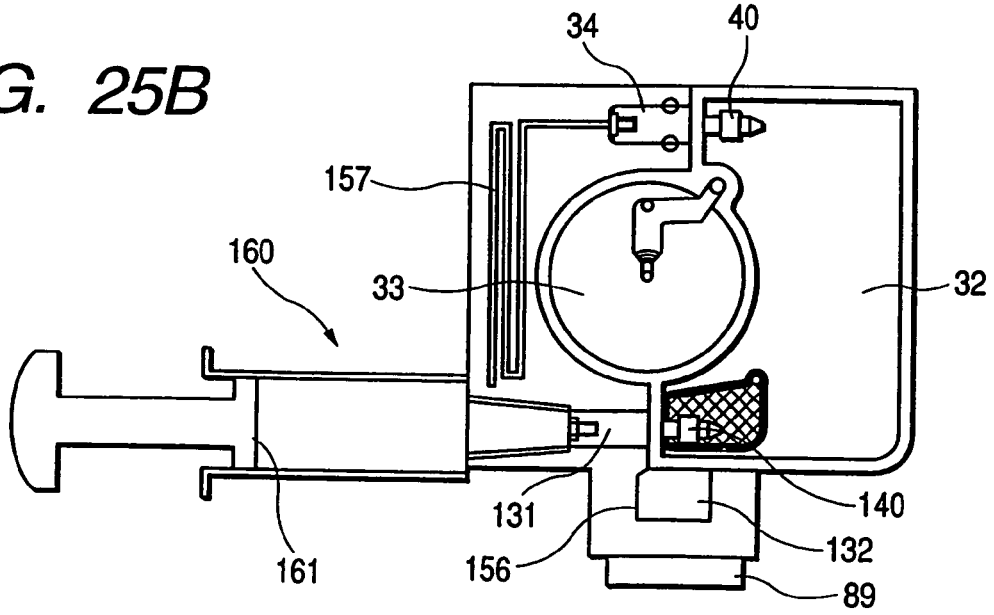
Figure 25C:
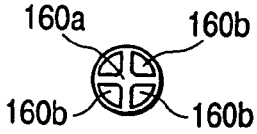

When ink in the ink cartridge 130 is consumed and refilling or replenishment of ink into the ink cartridge 130 is required, an ink refilling tool, such as a syringe 160, is inserted into the through hole 155 as shown in FIG. 25*b* so that a tip end of the syringe 160 presses the valve member 140 and the valve member 140 is put into an open valve condition. As shown in FIG. 25*c*, the tip end of the syringe 160 has a pressing portion 160*a* for pressing the valve member 140 and communication portions 160*b* for communicating an interior of the syringe 160 with the ink injecting connection port 131. Therefore, if the syringe 160 is inserted into the through hole 155 until the pressing portion 160*a* pushes the valve member 140 into the open valve condition, the interior of the syringe 160 is communicated via the ink injecting connection port 131 and the opening 142 with the interior of the ink storing chamber 32. If a piston 161 of the syringe 160 is pushed in this state, the ink in the syringe 160 is filled into the ink storage chamber 32 through the communication portions (openings) 160*b*, the ink injecting connection port 131 and the opening 142, while the air compressed within the ink storage chamber 32 in association with the refilling of the ink is discharged out of the ink storage chamber 32 via the atmosphere communicating connection port 34 and the capillary 157 to the atmosphere.

When the syringe 160 is removed after a predetermined quantity of ink is refilled into the ink storage chamber 32, the valve member 140 is moved by the biasing force of the spring 144 to establish the closed valve condition. Accordingly, it is possible to eliminate the ink leakage.

In addition, although ink is simply refilled in the above example, the following method may be applicable. That is, an empty syringe 160 is inserted into the recessed portion 155 to collect all of ink remaining in the ink storage chamber 32, and then a predetermined quantity of ink is refilled into the storage chamber 32 using the syringe 160. This method is advantageous in strictly managing the consumed ink amount associated with the printing quantity and accurately judging the remaining ink amount.

Figure 26A:
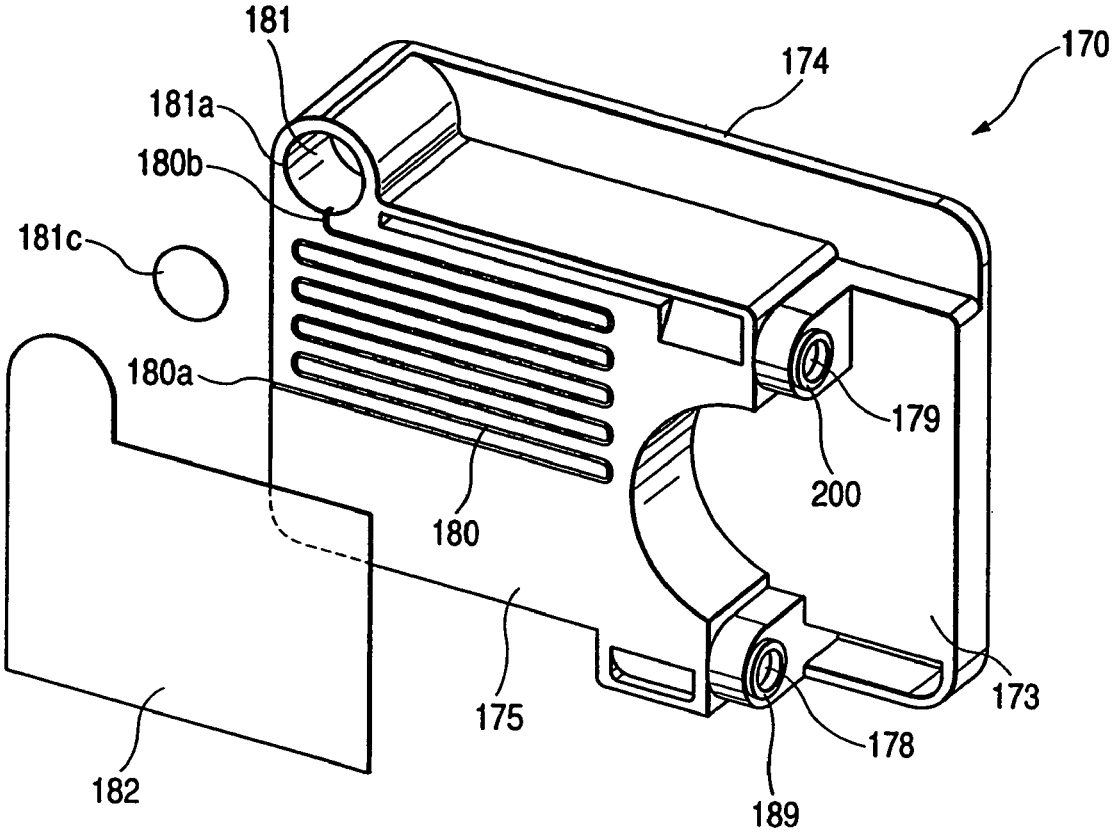
FIGS. 26A and 26B are views illustrating one example of the ink cartridge of the invention, and a concave portion of the ink cartridge in enlargement.
Figure 26B:
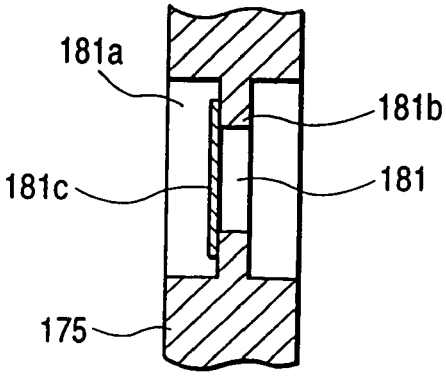
Figure 27:
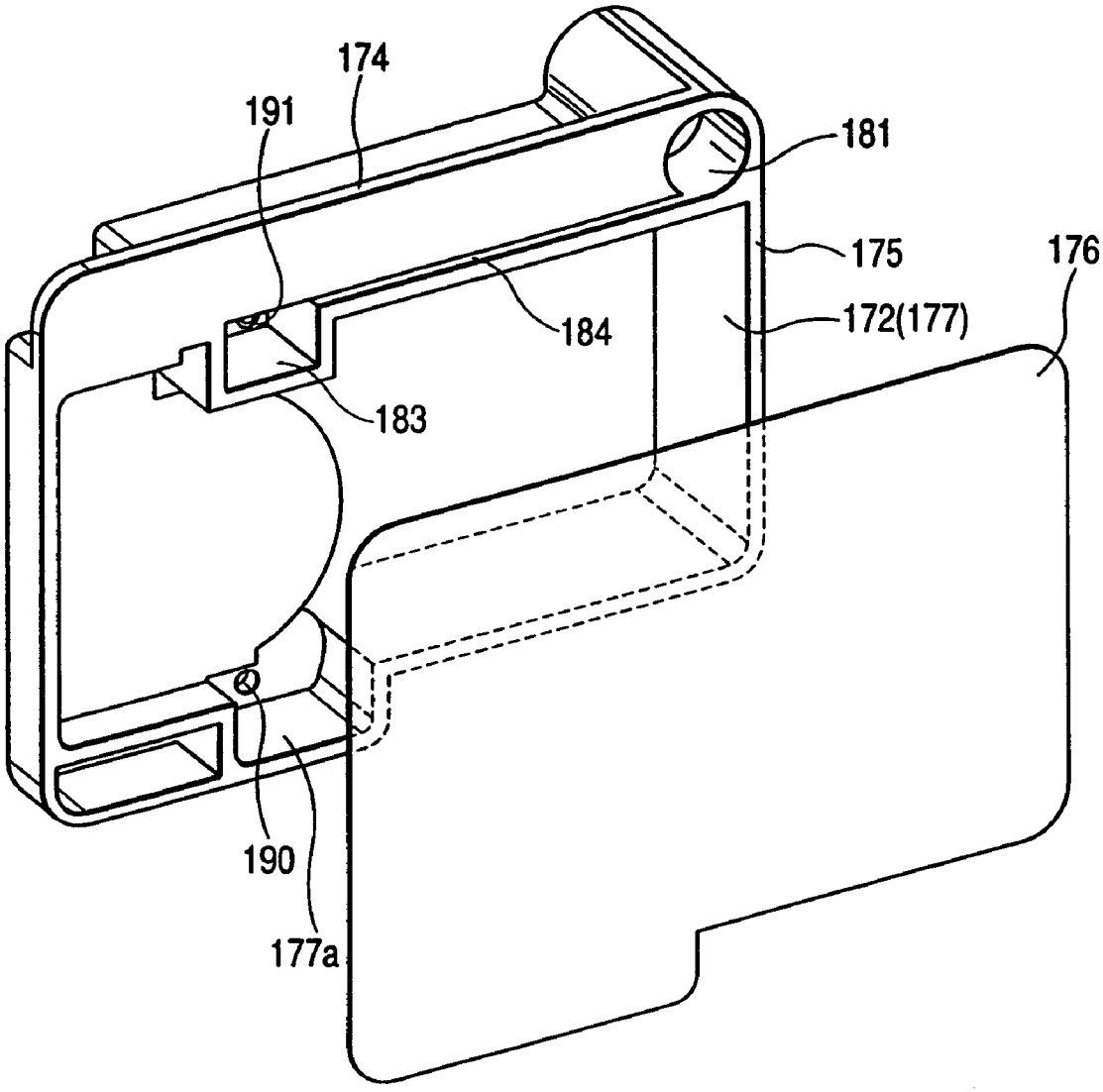
FIG. 27 is a view illustrating a structure of the back face of the one example of the ink cartridge.

FIGS. 26A, 26B and FIG. 27 illustrate a fifth example of the ink cartridge according to the invention, regarding the structure on the front and back sides. The ink cartridge 170 comprises a base member 175 having a recessed portion 172 opening on one face, and the guide portions 173, 174 protruding in parallel to this opening face upward and in an insertion direction, and a film 176 for sealing the recessed portion 172 to define an ink storing chamber 177 between the base member 175 and the film 176. The film 176 is deformable depending on the fluctuation of the ink pressure, and is made of a material having the air impermeable property and the adhesion property.

At a lower position when the cartridge 170 is attached to the recording apparatus, there is provided an ink supply port 178 in which a valve mechanism is installed. An atmosphere communicating connection port 179 is formed at an upper position. A meandering narrow groove 180 is formed on the surface of the base member 175 defining a bottom of the recessed portion 172. One end 180*a* of the groove 180 is opened to a side face of the base member 175 and the other end 180*b* thereof is connected to a large diameter portion 181*a* of a recessed portion 181.

As shown in FIG. 26B, the recessed portion 181 is formed with a frame portion 181*b* having a slightly smaller diameter. An air permeable film 181*c* having ink repellent property is adhered to or welded to this frame portion 181*b* as a partition for the large diameter recessed portion 181*a* serving as an ink trap. The air permeable film 181*c* is made, for example, of a porous film of fluorine resin, and has desirably an ink repellant ability of 3000 to 5000 Pa or more, which is higher than the ink holding force of the meniscus at the nozzle openings in the recording head.

The exposed face where the narrow groove 180 and the recessed portion 181 are formed is sealed with a film 182 having the air permeability and the adhesion property so that the narrow groove 180 forms the capillary and the recessed portion 181 constitutes the ink trap.

This recessed portion 181 is connected via a connecting recessed portion 184 to a communication chamber 183 formed in the vicinity of the atmosphere communicating connection port 179. The connecting recessed portion 184 and the communication chamber 183 are sized in cross section to secure such an interstice that ink does not reach at least the recessed portion 181 owing to a capillary force and desirably the ink is returned to the communication chamber 183 owing to a difference in water head from the liquid face of ink in the ink storing chamber 177 (the recessed portion 172) even if the ink flows into the recessed portion 181.

Figure 28:
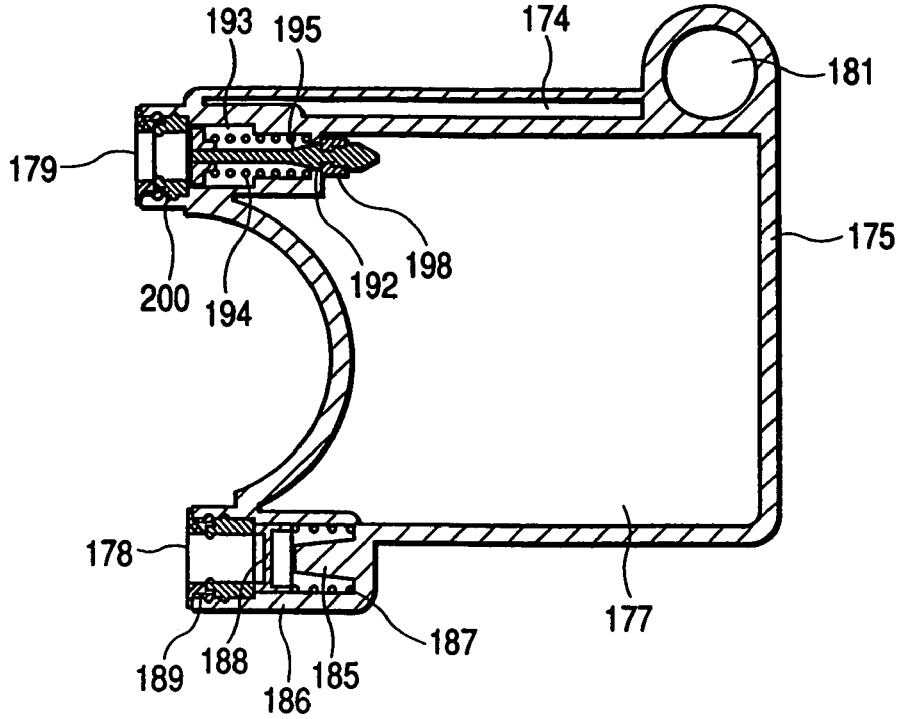
FIG. 28 is a view illustrating a cross-sectional structure of the one example of the ink cartridge.

FIG. 28 illustrates a structure in cross section of the ink cartridge 170. The ink supply port 178 is formed with a tubular portion 186 having a spring receiving portion 185 shaped like a truncated cone at its center. A valve member 188 is movably fitted to the tubular portion 186, and the valve member 188 is urged toward the ink supply port by a coil spring 187 guided by the spring receiving portion 185 so as to be constantly contacted elastically with a packing 189. The packing 189 serving as a removal preventing member is fitted to the ink supply port side of the tubular portion 186. This tubular portion 186 has a passage hole 190 (see FIG. 27) communicating with the ink storing chamber 177 in a state where the valve member 188 is pressed onto the spring receiving portion 185.

Figure 29A:
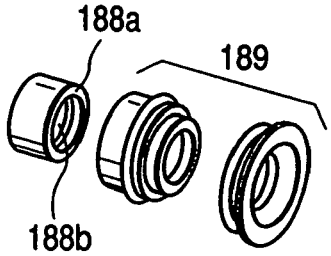
FIGS. 29A and 29B are views illustrating one example of a valve plug for use in the ink cartridge, respectively.

As shown in FIG. 29A, the valve member 188 has a tubular portion 188*a* sliding on the inner face of the tubular portion 186, and a partition wall 188*b* formed in its central part. An operation lever of the recording head side and the spring receiving portion 185 can be brought into contact with the partition wall 188*b*.

On the other hand, the atmosphere communicating connection port 179 is formed with a tubular portion 193 that communicates via an opening 191 (see FIG. 27) with the communication chamber 183 and that also communicates via a through hole 192 with an upper part of the ink storing chamber 177. A valve member 195 is fitted to the tubular portion 193, which is urged outward by a coil spring 194, and a packing 200 serving as a removal preventing member is fitted to the opening side of the tubular portion 193.

Figure 29B:
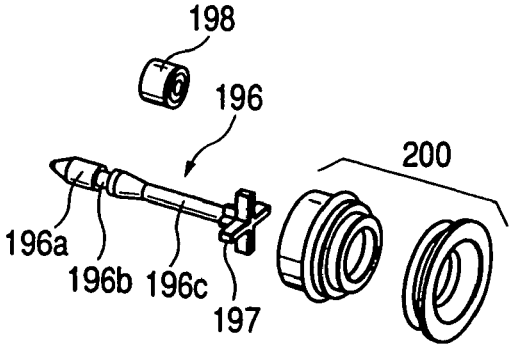

The valve member 195 is constructed by an operation rod 196 insertable into an opening 192, a pressure receiving member 197, and a seal member 198, as shown in FIG. 29B. The seal member is fitted around an annular groove portion 196*b* formed in a large diameter portion 196*a* of the operation rod 196, a small diameter portion 196*c* is passed through the opening 192 from the side of the ink storing chamber, a coil spring 194 is fitted around the small diameter portion 196*c*, and then the pressure receiving member 197 is secured at the tip end of the small diameter portion 196*c*.

If the inner diameter of the opening 192 is greater than the outer diameter of the large diameter portion 196, and smaller than the outer diameter of the seal member 198, the seal member 198 can be fitted to the operation rod 196 on the side of the ink chamber in a state where the operation rod 196 has been inserted into the opening 192, and the coil spring 194 can be inserted from the side of the atmosphere communicating connection port 179 and then the pressure receiving member 197 can be secured to the operation rod 196.

Figure 30:
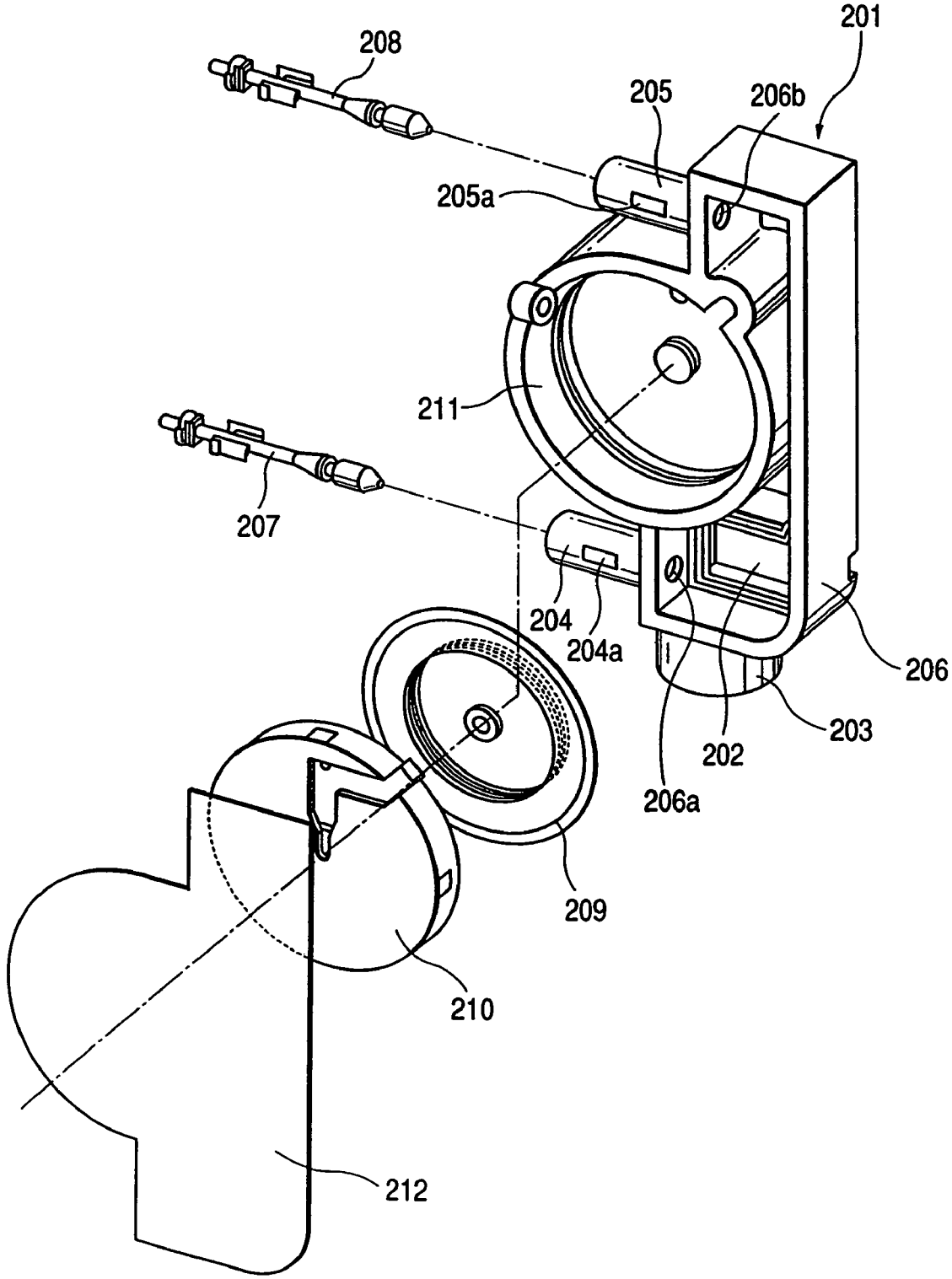
FIG. 30 is an exploded perspective view illustrating one example of the connection unit in the recording unit on which the ink cartridge is attached.
Figure 31:
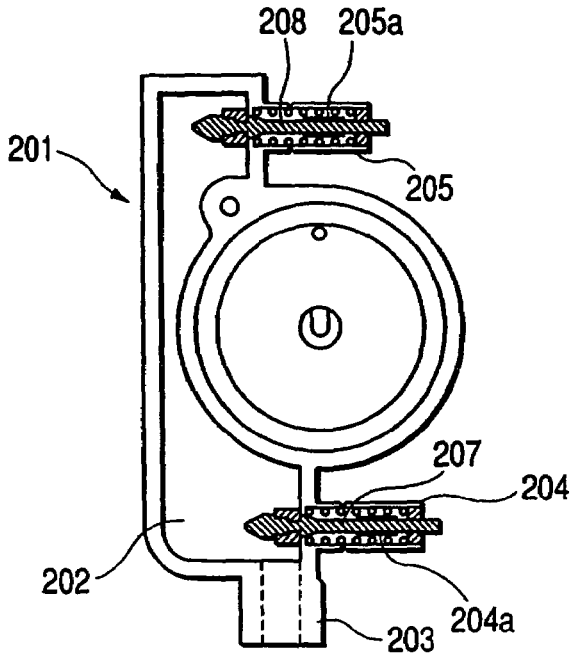
FIG. 31 is a view illustrating a cross-sectional structure of the one example of the connection unit.

FIGS. 30 and 31 illustrates a fifth example of a connection unit suitable for the ink cartridge 170. This connection unit 201 is designed to be connected to the ink cartridge 170 such that an upper space of an ink reserving chamber 202 is communicated with the atmosphere, and a lower part thereof receives ink to supply thus received ink through an ink flow port 203 on the bottom to the recording head.

And an ink inflow tube 204 having an ink inflow notch 204*a* at the leading end portion and an atmosphere communicating tube 205 having an atmosphere inflow notch 205*a* at the leading end portion are formed at the respective positions opposed to the ink supply port 178 of the ink cartridge, and the atmosphere communicating connection port 179 thereof. The ink inflow tube 204 and the atmosphere communicating tube 205 are in communication with the ink reserving chamber 202 via the through holes 206*a*, 206*b* of a case 206 constituting the connection unit 201. Valve members 207, 208 having the substantially same constitution as the valve member 195 as previously described are provided to the ink flow tube 204 and the atmosphere communicating tube 205, respectively.

In this example, to supply ink in the ink reserving chamber 202 into the recording head at a constant negative pressure, a negative pressure chamber or negative pressure generating system is constructed in which a diaphragm valve or membrane valve 209 and a flow passage formation member 210 are incorporated in a recessed portion 211, and the outside of the recessed portion is sealed with a film 212 having high air impermeability. The negative pressure generating system in this example is substantially the same in construction as the negative pressure generating system of the former examples.

Figure 34A:
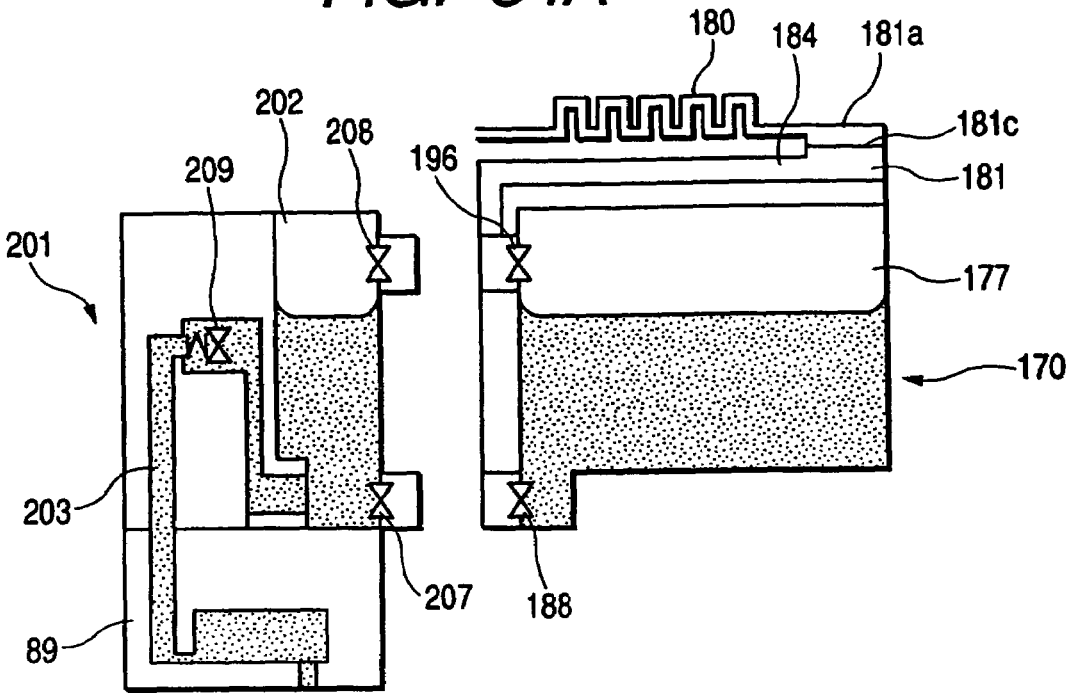
FIGS. 34A and 34B are views typically illustrating the structure of a flow passage in a state where the ink cartridge is not attached to the connection unit and in a state where the ink cartridge is attached to the connection unit, respectively.

In this example, in a state in which the ink cartridge 170 is not attached to the recording apparatus, the passage hole 190 of the ink supply port 178 and the opening 192 of the atmosphere communicating connection port 179 are sealed by the valve members 188 and 195, respectively, so that the ink storing chamber 177 is isolated from the atmosphere. The connection unit 201 is also sealed by the valve members 207, 208 (FIG. 31 and FIG. 34A).

Figure 32:
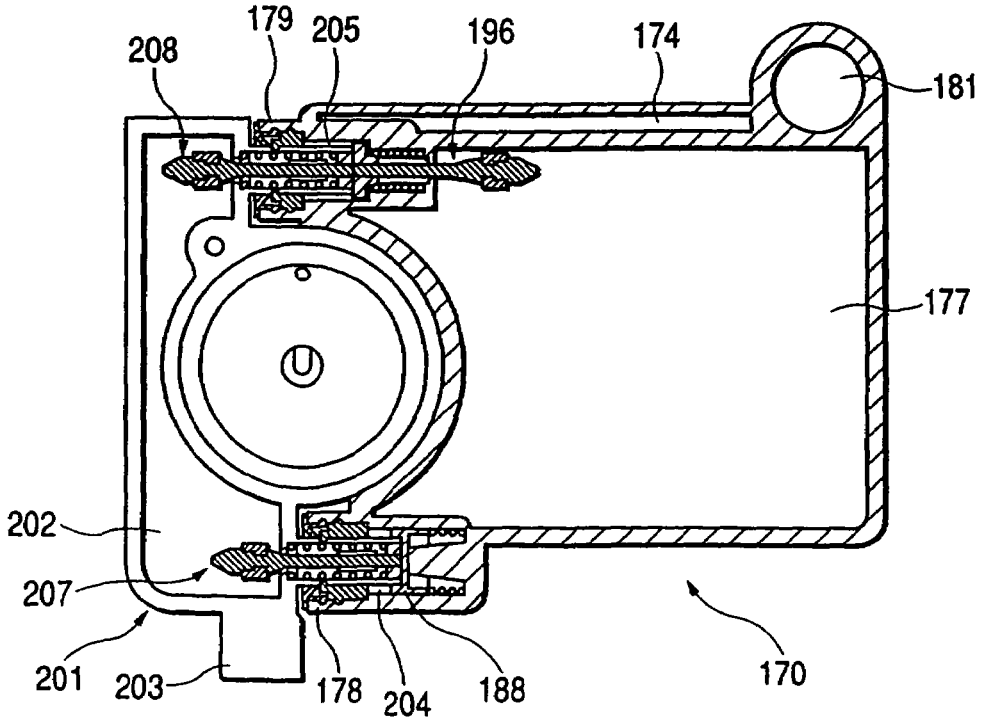
FIG. 32 is a cross-sectional view illustrating a state where the ink cartridge is attached to the connection unit.
Figure 33A:
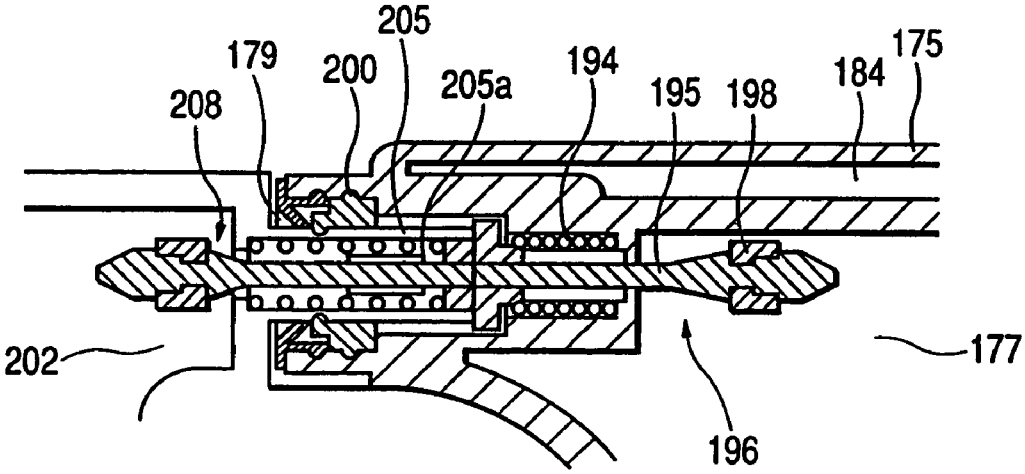
FIGS. 33A and 33B are cross-sectional views illustrating in enlargement the state of the valve plugs in an atmosphere communicating end connection and an ink supply port in which the ink cartridge is attached to the connection unit, respectively.
Figure 33B:
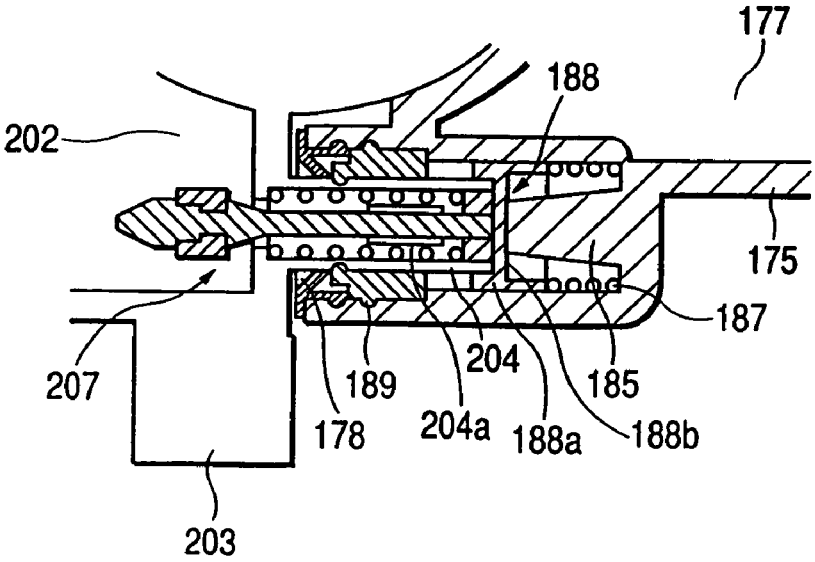

During the course of attachment of the ink cartridge 170 to the connection unit 201, the ink inflow tube 204 and the atmosphere communicating tube 205 are fitted to and relatively moved with respect to the packing 189 of the ink supply port 178 and the packing 200 of the atmosphere communicating connection port 179, so that the leading ends of the ink inflow tube 204 and the atmosphere communicating tube 205 presses and moves the partition wall 188*b* of the valve member 188 and the pressure receiving member 197 of the valve member 196 to the predefined positions, regardless of the resiliency of the springs 187, 194 and the fixing caused by the solidified ink. (See FIGS. 32, 33*a* and 33*b*).

Consequently, the passage hole 190 in communication with the ink storing chamber 177 is opened, and the seal member 198 is separated from the opening 192, so that the tubular portion 193 and the ink storing chamber 197 are communicated via the recessed portion 181 and the narrow groove 180 with the atmosphere.

The relative positions or relative dimensions of the atmosphere communicating tube 205, the atmosphere communicating port 179, the ink inflow tube 204 and the ink supply port 178 are set such that a position where the atmosphere communicating tube 205 is jointed to the atmosphere communicating connection port 179, namely a timing at which the valve is open when the tube 205 is jointed to the port 179, is prior to a timing at which the valve member 188 is opened by the ink supply port 178 and the ink inflow tube 204. This makes it possible to prevent the leakage of the ink that may occur when the ink cartridge 170 is attached.

That is, in the case where the air in the ink storing chamber 177 is expanded to raise the pressure above the atmospheric pressure, the valve member 196 of the atmosphere communicating connection port 179 is opened in a state where the valve member 188 of the ink supply port 178 is kept in a closed valve condition, thereby causing the air in the ink storing chamber 177 to escape out of the ink storing chamber 177. Since the ink is maintained at an atmospheric pressure when the ink supply port 178 is opened subsequently, the ink is prevented from leaking out of the ink supply port 178.

Figure 34B:
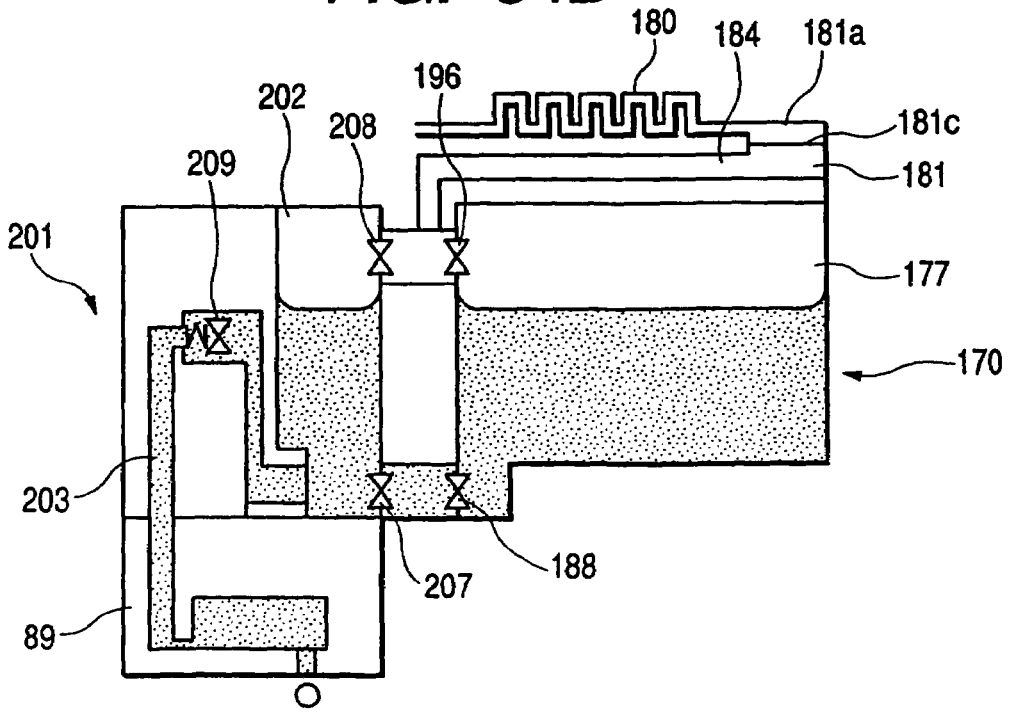

In this state, since each of the valve members 207, 208 of the connection unit 201 is opened, the ink in the ink storing chamber 177 can be supplied by the connection unit 201 through the ink flow port 203 to the recording head, as shown in FIG. 34B. In this state, the ink storing chamber 177 of the ink cartridge. 170 and the ink reserving chamber 202 of the connection unit 201 are in communication with the atmosphere via the capillary formed by the narrow groove 180 and the film 182. Accordingly, ink required by the recording head 89 can be supplied thereto securely, and the vapor of the ink solvent in these chambers 177, 202 can be prevented from being dispersed to the atmosphere.

If the attitude of the cartridge 170 is subjected to a great change by the movement of the recording apparatus, ink may reach the upper opening 192 and leaks out of the opening 192 to the communication chamber 183. This ink flows through the recessed portion 184 and is trapped in a wide space of the recessed portion 181. Further, since the recessed portion 181 is divided by the air permeable film 181*c*, the ink is prevented from flowing into the groove 180, and leaking outside the cartridge 170, even if the recording apparatus is turned upside down at the time of movement or storage.

Further, if the air permeable film 181*c* is provided with the ink repellant ability higher than the ink holding power of the meniscus at the nozzle openings in the recording head 89, the ink may leak out from the recording head but cannot leak out from the cartridge 170 even in the case where the ink storing chamber 177 has an increased pressure caused by the expanded air in the ink storing chamber 177.

Even if the ink flows out from the nozzle openings of the recording head, the recording apparatus is polluted by the ink, because, in general, the nozzle openings are sealed with a cap for preventing the clogging of the nozzle openings.

The ink having flowed into the recessed portion 181 is returned, through the recessed portion 184 where the interstice is too large to exhibit the capillary force, to the communication chamber 183 by gravity, and then through the opening 192 to the ink storing chamber 177, after the ink cartridge 170 is restored to its original normal attitude.

As the ink is consumed by the recording head, the ink is collected in a small chamber 177*a* formed as a recessed portion on the bottom of the ink storing chamber 177. Consequently, the ink level is maintained above the passage hole 190, so that the ink can be supplied to the recording head 89 substantially to the last.

In the case where the ink cartridge 170 is replaced to change the printing medium or the like, the ink cartridge 170 is removed from the connection unit 201, so that the ink inflow tube 204 and the atmosphere communicating tube 205 is pulled off. As a result, the valve members 188 and 195 of the ink supply port 178 and the atmosphere communicating connection port 179 are pushed back by the springs 187, 204 to seal the passage hole 190 and the opening 192 communicated with the ink storing chamber 177. Consequently, the ink or the ink solvent in the ink storing chamber 177 can be prevented from leaking or evaporating.

In the above example, the ink cartridge is attached to the recording head by the connection unit 201 having the negative pressure generating system. However, it will be apparent that the ink cartridge may be connected without interposing the differential pressure valve mechanism constituting the negative pressure generating system, when the ink holding force at the meniscus of the nozzle openings in the recording head is fully high.

Figure 35A:
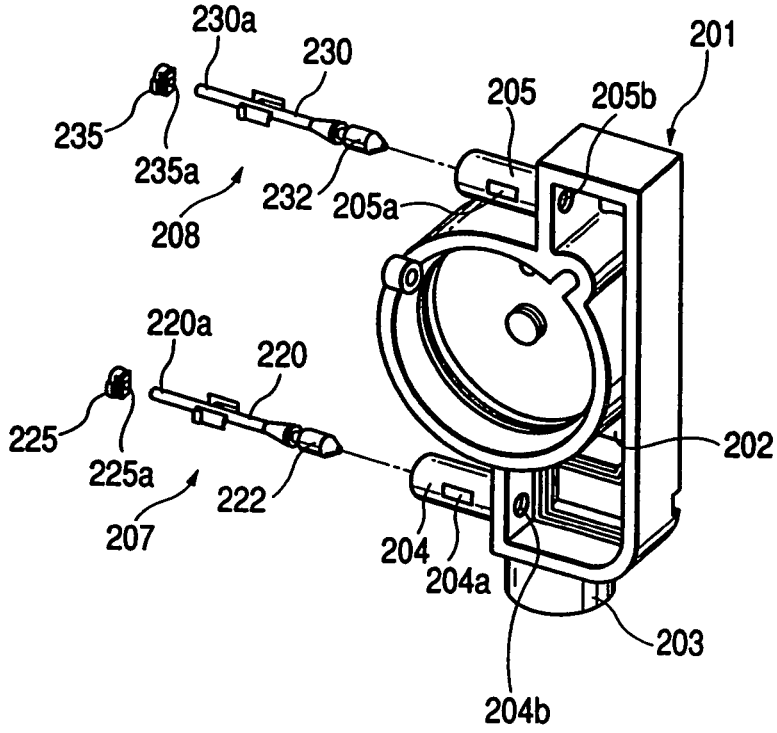
FIGS. 35A, 35B and 35C are perspective views illustrating the ink supply port exploded and in enlargement, respectively.
Figure 35B:
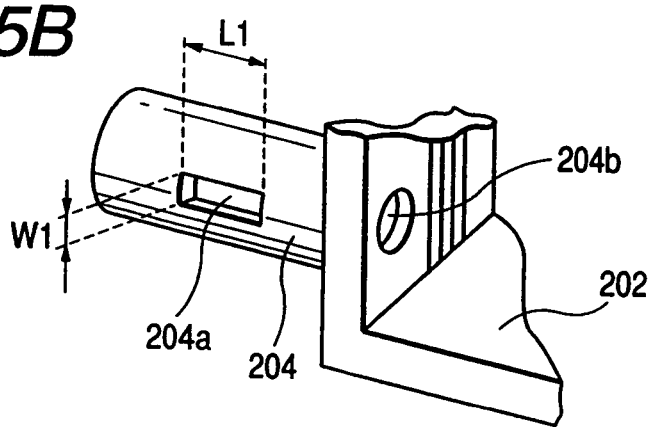
Figure 35C:
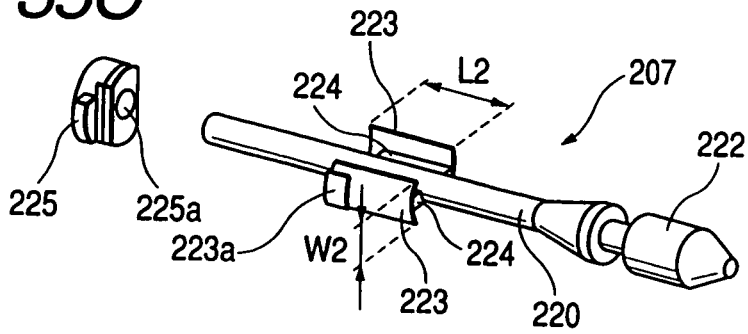

FIG. 35 illustrates a sixth example of the connection unit. The connection unit 201 comprises an ink reserving chamber 202 extending vertically on one side, an atmosphere communicating connection port 205 and an ink inflow connection port 204, each in the form of a tubular member to be connected to an external system, which are respectively formed on an upper part and a lower part of the ink reserving chamber 202, and an ink flow port 203 communicating with the recording head 89 at the bottom.

Each of the connection ports 204, 205 has a communication window 204*a*, 205*a* on its peripheral face, and accommodates an axially movable valve member 207, 208 therein. Each of the valve members 207, 208 is accommodated such that one end 220*a*, 230*a* of a slide shaft 220, 230 projects from the connection port 204, 205.

Each of the valve members 207, 208 is provided with a packing 222, 232, which is fitted to the other end of the slide shaft 220, 230 and made of a resilient material, for sealing an in storing chamber side opening 204*b*, 205*b* communicated with the connection port 204, 205. As mentioned above, the valve member 207, 208 is inserted into the connection port 204, 205 in such a manner that the packing 222, 232 is elastically contacted with the opening 204*b*, 205*b* by the action of a spring.

The details of the valve mechanisms using the valve members 207, 208 will be described below by taking the ink inflow end connection 204 as an example. In addition, the construction of the valve mechanism described below can be applied to the former examples.

The connection port 204 in the form of a tubular member has the window 204*a* of a substantially rectangular opening having the length L1 and the width W1 and extending in a direction of central line as shown in FIG. 35B. The valve member 207 includes the slide shaft 220 that is sufficiently narrow in diameter so as not to hinder ink flow but have rigidity to withstand the movement thereof, and sealing portions 223, each arcuate in cross section, and having the length L2 and the width W2 to seal the window 204*a*. The sealing portions 223 are secured to ribs 224 serving as a spring seat to be located in regions opposed to the windows 204*a* when the valve member 207 is urged by a spring.

On the stop position side (left side in the figure) of the sealing portion 223 in the urged state, a removal preventing portion 223*a* is formed to be movably engaged with the window 204*a* of the ink inflow connection port 204. In the drawings, reference numeral 225, 235 denotes a fixture having a through hole 225*a*, 235*a*, into which the slide shaft 220, 230 is inserted, for movably supporting one end 220*a*, 230*a* of the slide-shaft 220, 230.

If the ink cartridge 170 having the structure as shown in FIG. 28 is attached to the connection unit 201 thus constituted, the slide shaft 220, 230 of the connection unit 201 is pressed and moved against the biasing force of the spring, so that the packing 222, 232 is moved to the side of the ink reserving chamber 202 to open the opening 204*b*, 205*b*. Similarly the valve member 188, 196 of the ink cartridge 170 (see FIG. 32) is also opened. Consequently, the ink in the ink cartridge flows into the connection unit 201 to allow the ink to be supplied to the recording head, as previously described.

If the ink cartridge 170 is removed from the connection unit 201 because the ink in the ink cartridge 170 is consumed completely, or because of the replacement of the ink, the slide shafts 220, 230 of the connection unit 201 and the valve members 188, 196 of the ink cartridge 170 are released from their supports, so that the valves are closed by the biasing force of the springs.

Consequently, the atmosphere communicating connection port 205 and the ink inflow connection port 204 of the connection unit 201 are closed to prevent evaporation of the ink solvent from the atmosphere communicating connection port 205, and the ink leakage from the ink inflow connection port 204.

Figure 36A:
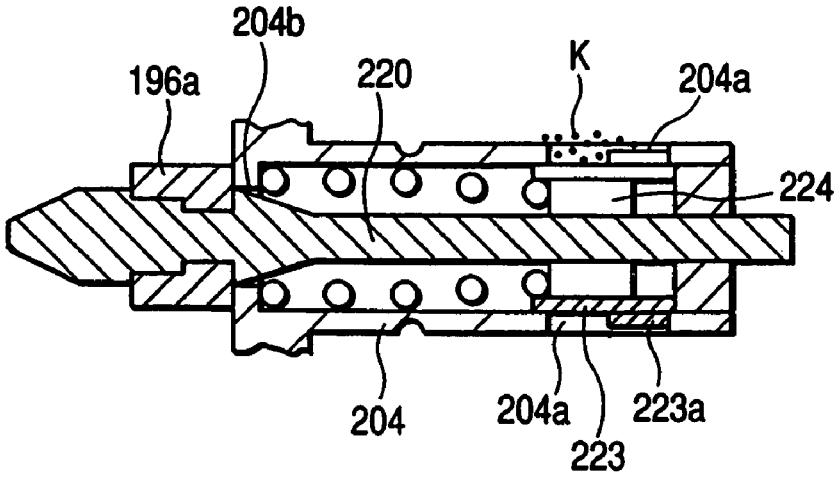
FIGS. 36A and 36B are views illustrating a state where the ink cartridge is pulled out, and a state of the ink supply port in a process where the ink cartridge is attached, respectively.
Figure 36B:
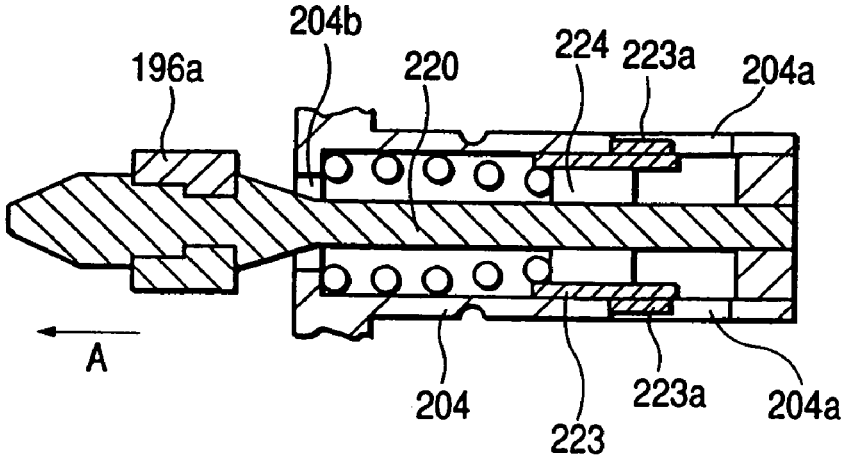

In a state where the ink cartridge 170 is pulled out, the ink inflow connection port 204 of the connection unit 201 is exposed to the atmosphere, so that the solvent of ink K adhering to the window 204*a* evaporates, and the ink is solidified, as shown in FIG. 36A. In this state, if the ink cartridge 170 is attached again, the slide shaft 220, 230 of the connection unit 201 and the ink cartridge 170 are pushed back in a direction of the arrow A, and in this process the removal preventing portion 223*a* is moved along the window 204*a* to clean up the ink solidified on the window 204*a*, as shown in FIG. 36B.

Consequently, in a state where the ink cartridge 170 is attached, the window 204*a* is opened normally, so that the ink flows from the ink cartridge 170 into the connection unit 201.

Figure 37:
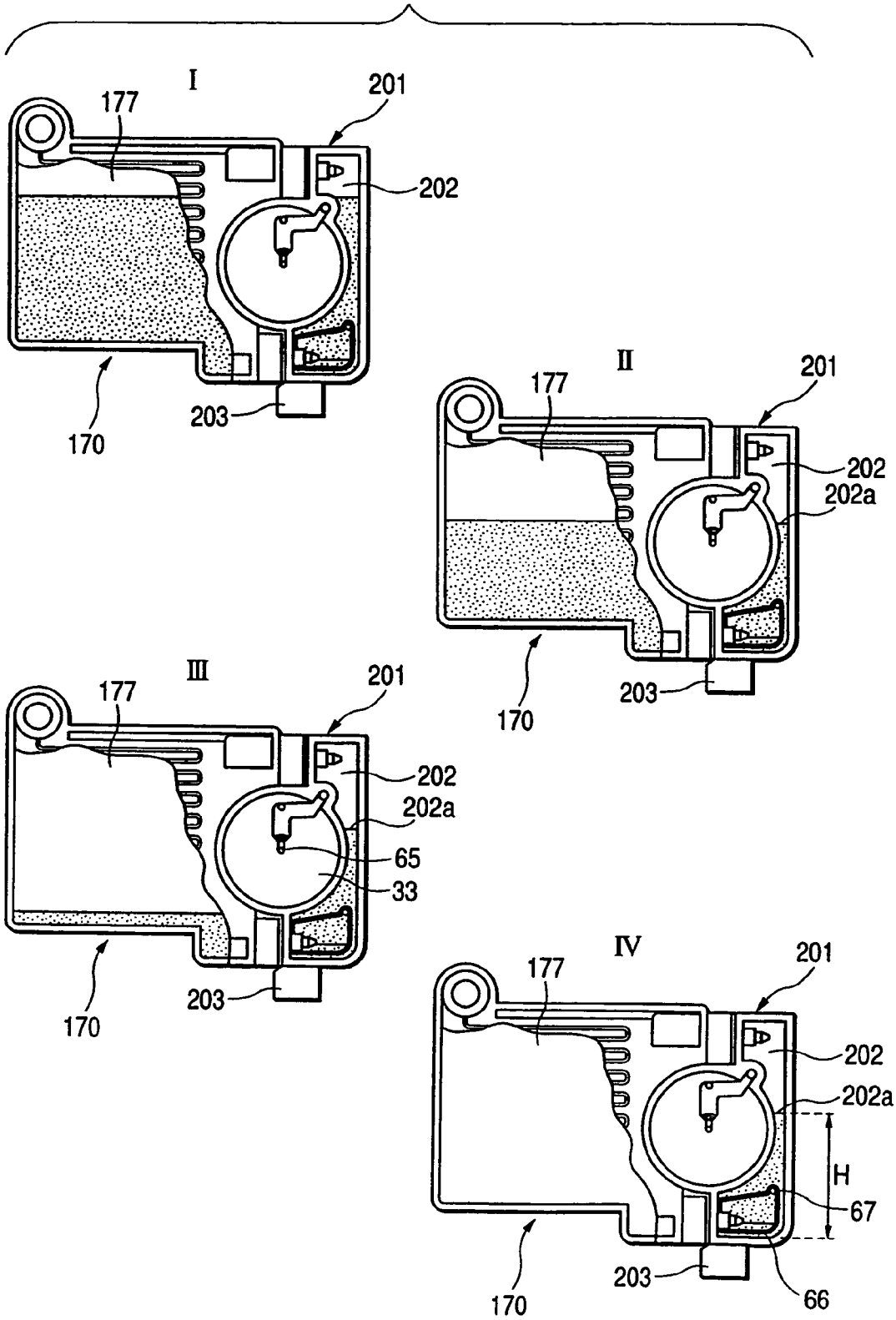
FIG. 37 is a view illustrating how ink is consumed in the connection unit and the ink cartridge.

FIG. 37 illustrates in detail the flow of the ink from the ink cartridge 170 to the connection unit 201. If the ink in the ink cartridge 170 (FIG. 37I) is consumed, and the ink level drops to a narrow portion 202*a* formed in the ink reserving chamber 202 of the connection unit 201 (FIG. 37II), the ink level of the ink reserving chamber 202 is maintained at the narrow portion 202*a* owing to a capillary force of the narrow portion 202*a*.

On the other hand, if the diaphragm valve 61 is opened in accordance with a negative pressure produced by the ink consumption by the recording head, the negative pressure acts on the ink cartridge 170 so that the ink within the ink cartridge 170 flows into the recording head via the negative pressure generating system 33.

The ink of the ink cartridge 170 is supplied to the recording head (FIG. 37III), while the ink level of the ink reserving chamber 202 is maintained at a level H above the filter 66, desirably, the passage hole 67. All ink in the ink cartridge 170 is supplied to the recording head without causing an ink exhaustion within the connection unit which is difficult to replace (FIG. 37IV).

In the above example, the lowest ink level H of the ink reserving chamber 202 is maintained by a capillary force of the narrow portion. However, if a floating member 240 having a circular section is inserted into an upper part of the ink reserving chamber 202, as shown in FIGS. 38I to 38IV, the ink can be held at a predetermined level without depending on the capillary force of the narrow portion 202*a*.

Figure 38:
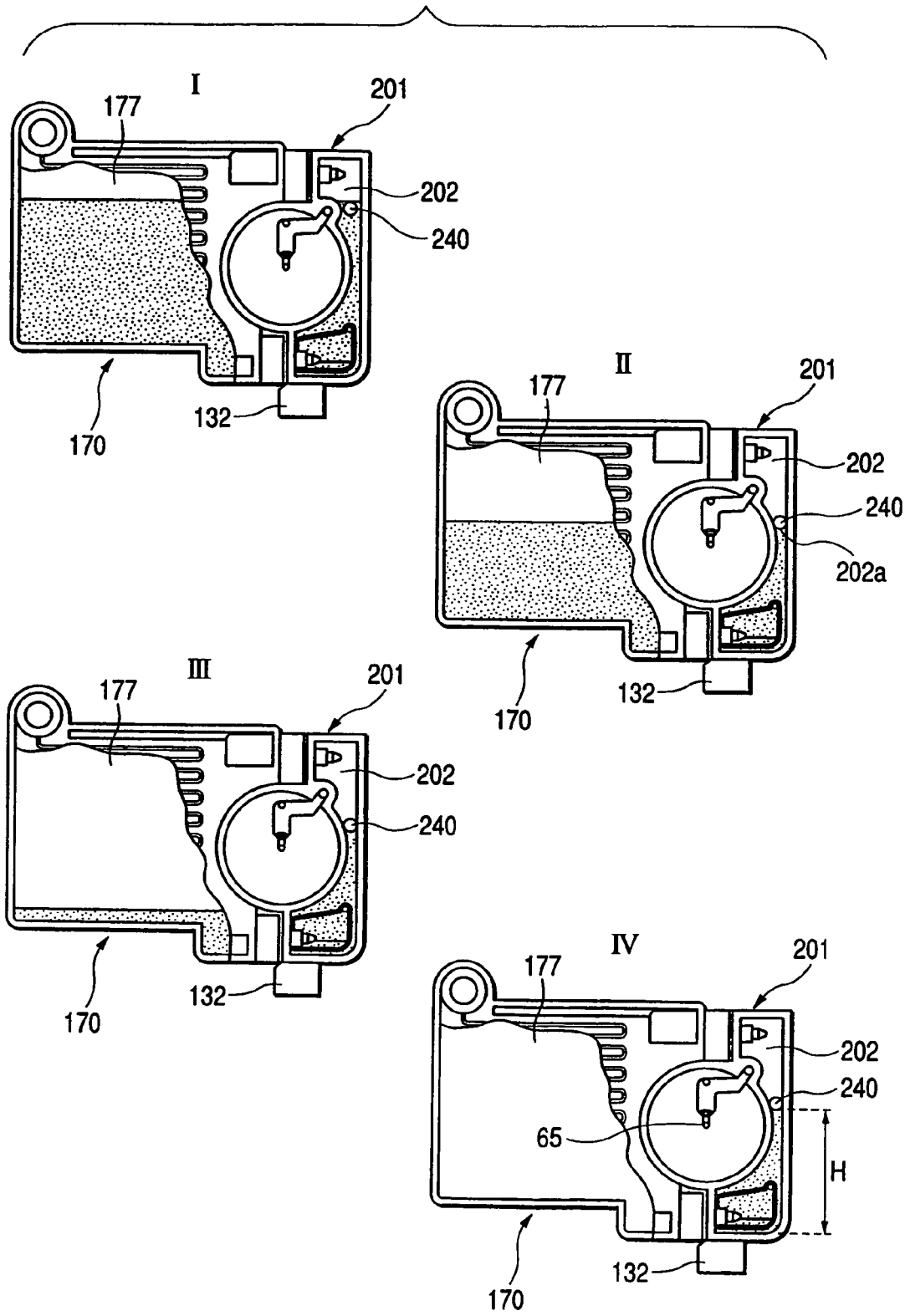
FIG. 38 is a view illustrating how ink is consumed in another example of the connection unit.

That is, in a state where there is a predetermined amount of ink, as shown in FIG. 38I, the floating member 240 is located above the narrow portion 202*a*, whereby the ink can be expelled without hindrance. If the ink level drops to the level H, the floating member 240 is prevented from falling by the narrow portion 202*a*, so that a capillary force is exhibited. Consequently, the ink level of the ink reserving chamber 202 can be maintained at the level H independently of the decrease in the ink of the ink cartridge (FIGS. 38II and 38III), in the same way as previously described. All ink in the ink cartridge 170 is supplied into the recording head while this state is kept (FIG. 38IV).

Figure 39:
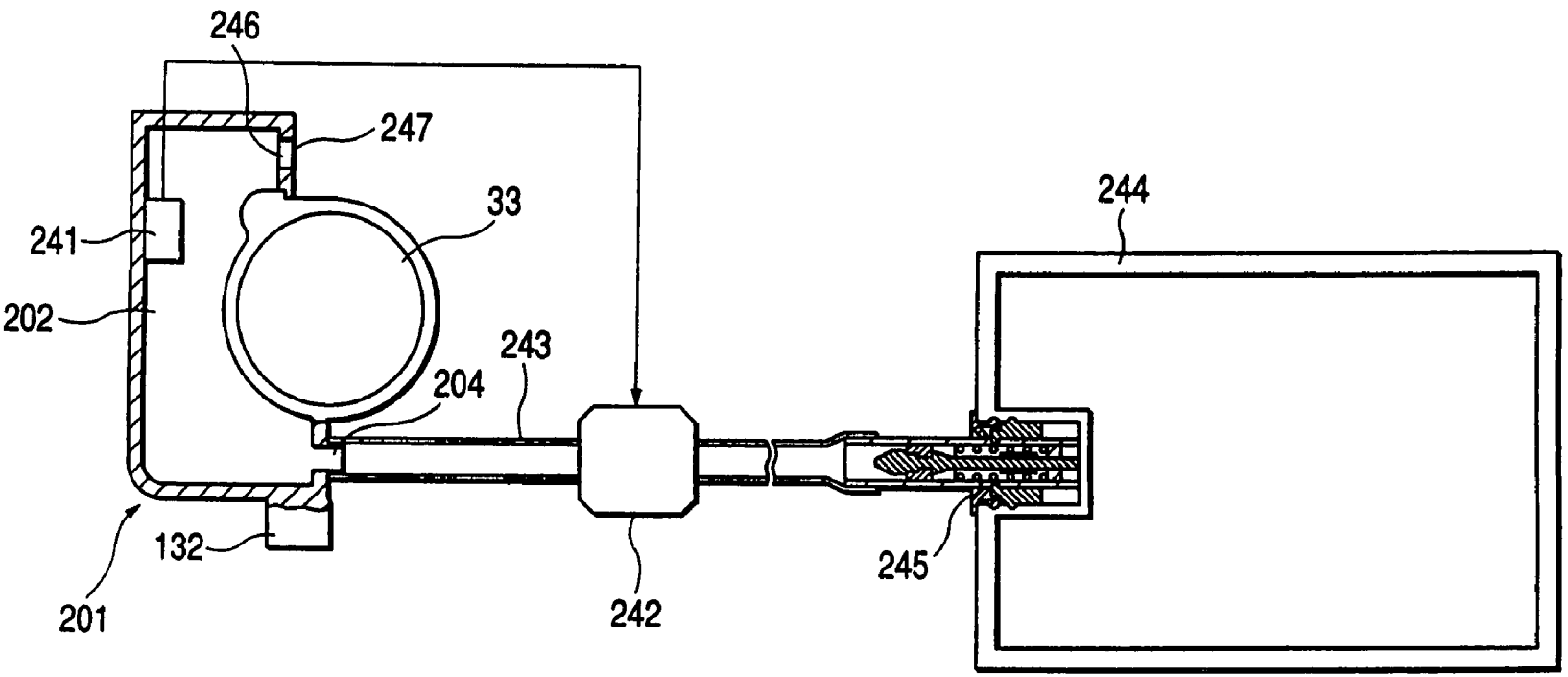
FIG. 39 is a configuration view illustrating another application example of the connection unit of the invention.

In the above example, the ink cartridge 170 is directly attached to the connection unit 201. However, a level sensor 241 may be provided in the connection unit 201 at a height at which the level of the ink reserving chamber 202 should be maintained, and the connection unit 201 may be connected to an ink flow port 245 of an ink storage member 244 such as an ink bag by a tube 243 via a liquid feeding pump 242 that is controlled by the level sensor 241 as shown in FIG. 39. This modification also provides the similar effect. In this case, it is desirable that an atmosphere communicating opening 246 is formed at an upper part of the ink reserving chamber 202, and sealed with a membrane 247 having the ink repellant property and the air permeability.

Figure 40:
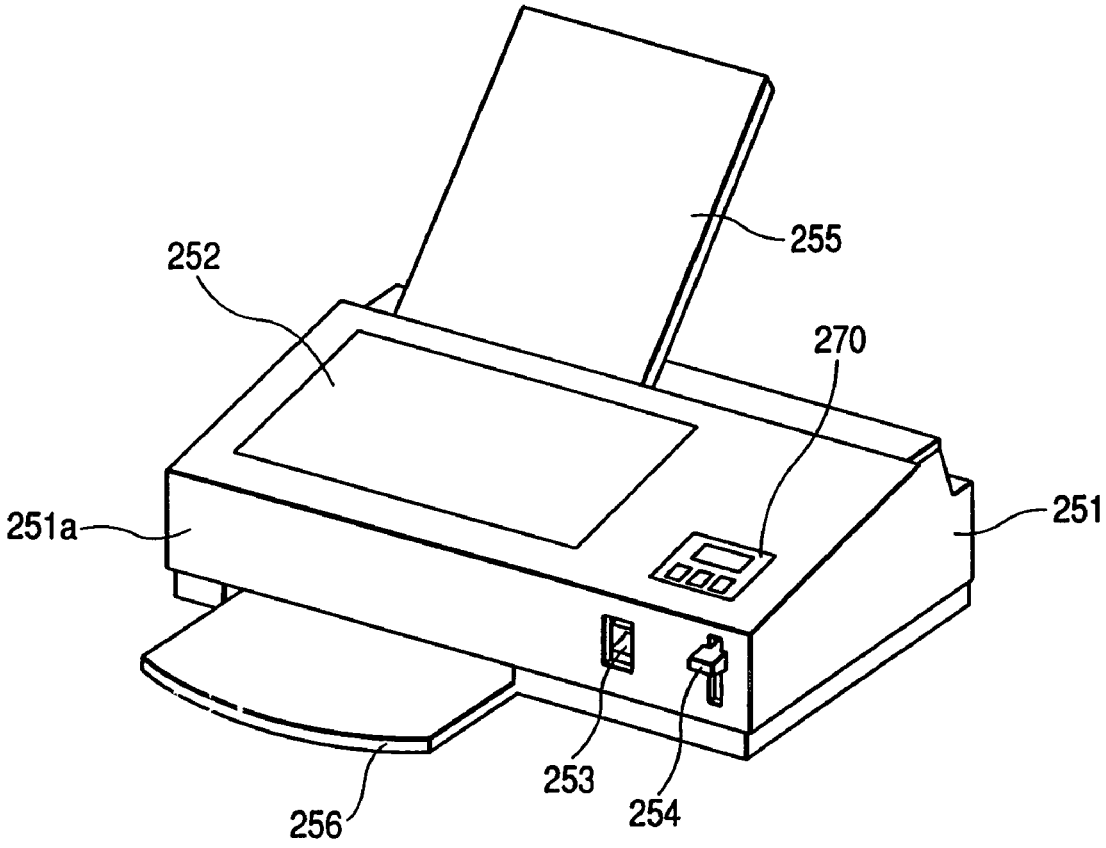
FIG. 40 is a view illustrating one example of an ink jet recording apparatus employing the ink cartridge and the connection unit.

FIG. 40 illustrates one example of an ink jet recording apparatus to which the ink cartridge 170 and the connection unit 201 are applied, wherein a case main body 251 for accommodating a printing mechanism and a cartridge replacement mechanism has a lid 252 on the upper face which can be opened or closed, and a window 253 for insertion and extraction of the cartridge and a lever 254 for pushing out the cartridge are provided at easily accessible one side portion of a front face 251*a*. A cut sheet holder 255 is provided on the back face of the case main body 251, and a paper delivery tray 256 is provided on a lower side of the front face.

Figure 41A:
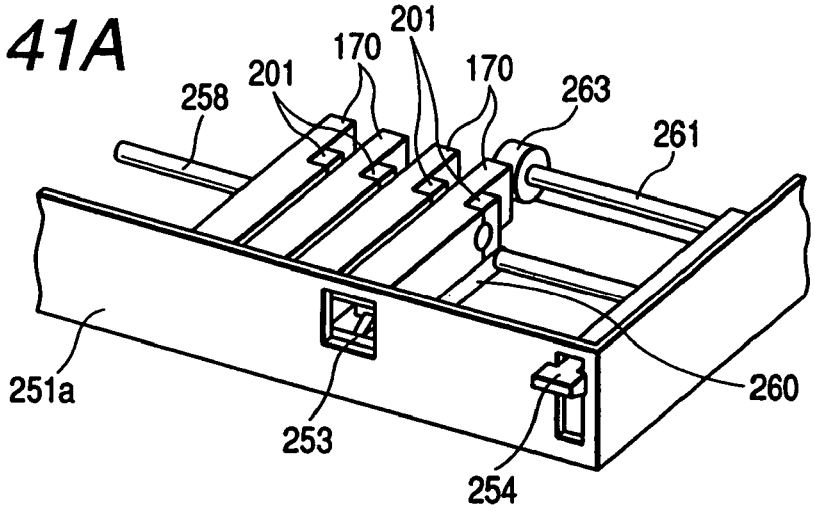
FIGS. 41A, 41B and 41C are a perspective view illustrating one example of a cartridge replacement mechanism of the ink jet recording apparatus, and views illustrating an attached state and a pulled-out state, respectively.

FIG. 41 illustrates one example of the cartridge replacement mechanism. A lever 254 is pivotably supported by a rotational fulcrum 257. The lever 254 extends to the back face of a carriage 260 which is reciprocally movable while being guided by a guide shaft 258 and on which a recording head 259 is provided. Fixed to the leading end (the back side end) of the lever 254 is an arm 261 extending parallel to the guide shaft 258. The recording head 259 is connected to the connection units 201 shown in FIG. 30, and supplied with the ink from the cartridges 170 via the respective connection units 201. In this example, the common recording head 259 is provided for the connection units 201, but a plurality of recording heads may be provided for the connection units 201, respectively. The arm 261 is provided with a pressing piece 263 in the form of a roller having such a width as to contact an aimed ink cartridge 170 but not to contact an adjacent cartridge 170. The pressing piece 263 is located at a position opposed to the window 253 for insertion and extraction.

Figure 41B:
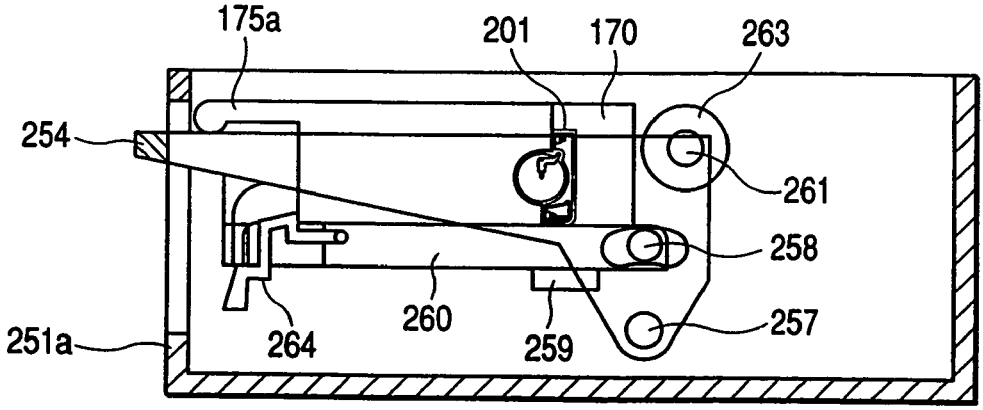
Figure 41C:
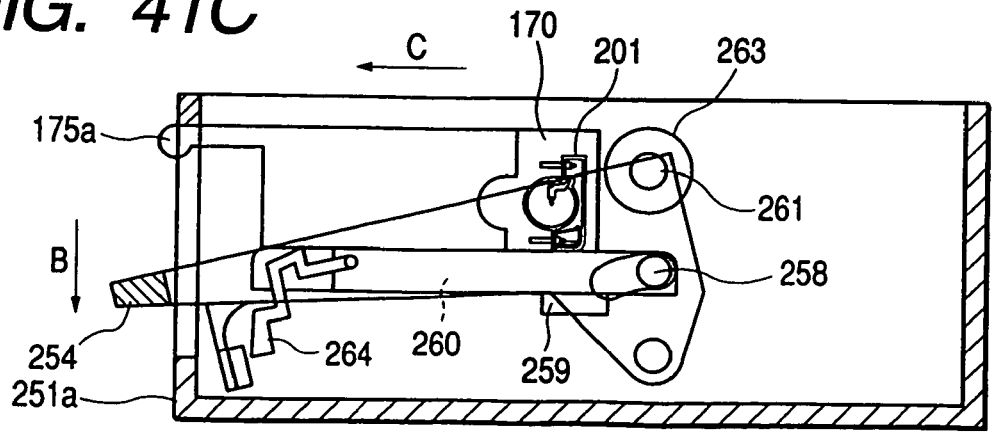

With such constitution, if the lever 254 is pressed down (in a direction of the arrow B in the figure), as shown in FIG. 41C, the pressing piece 263 is moved toward the front face and shifts a selected one of the cartridges 170, which is opposed to the window 253, toward the front face (arrow C in the figure). Consequently, the selected cartridge 170 is disengaged from the recording head 89, and can be taken out through the window 253.

Since the pressing piece 263 is made up of the roller that can rotate, it is possible to prevent an unnecessary external force caused by the rotation of the lever 254, i.e. a vertical force unnecessary to extract the ink cartridge, from being exerted on the cartridge 170 and the carriage 260.

If the pressure on the lever 254 is released, the lever 254 is moved upward by a biasing member 264, so that the pressing piece 263 is retracted to its original position (FIG. 41B).

Figure 42A:
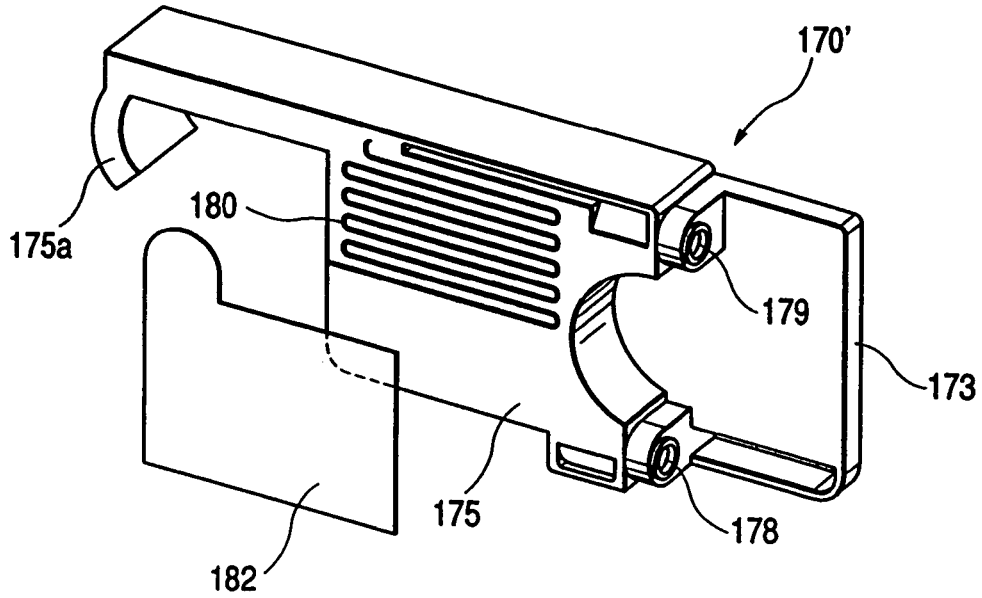
FIGS. 42A and 42B are views illustrating one example of the ink cartridge that is suitable for the recording apparatus, respectively.
Figure 42B:
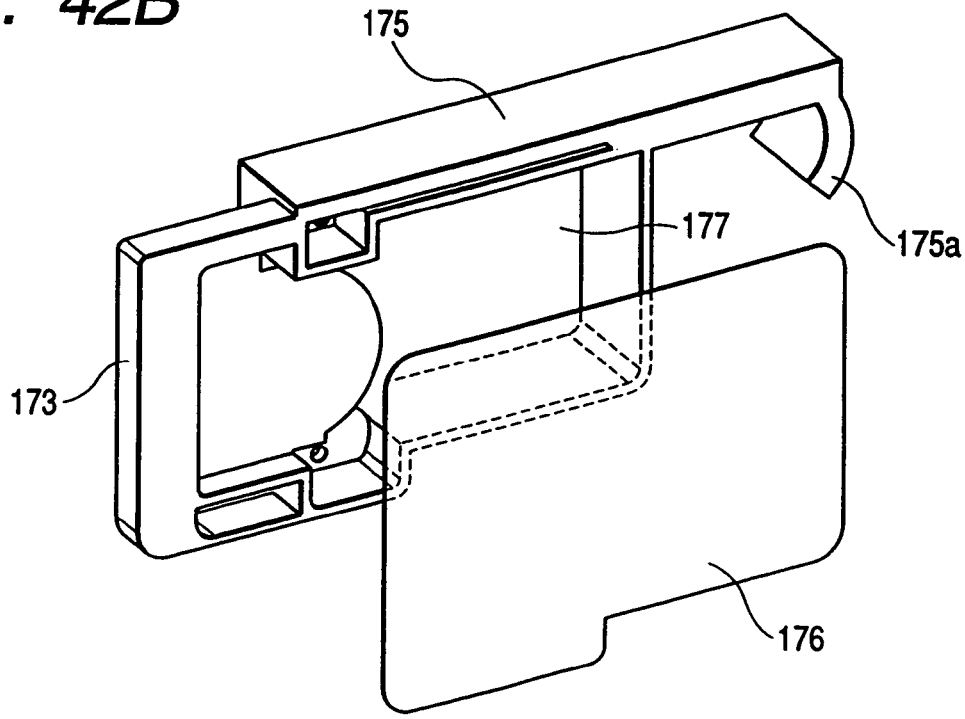

FIGS. 42A and 42B illustrate one example of an ink cartridge that is suitable for the recording apparatus. The ink cartridge is fundamentally constituted in the same way as the ink cartridge 170, except that a grip portion 175*a* is formed at the other end side, in addition to a guide portion 173 on the rear side, in consideration of the operability for insertion and extraction.

In this example, if the ink cartridge 170' is specified on a panel 270 at a stage where the ink of the ink cartridge 170' is consumed, the carriage 260 is moved to a position at which the specified ink cartridge 170' is opposed to the cartridge insertion and extraction window 253 of the case main body 251.

In this state, if the lever 254 is pressed down, the pressing piece 263 is moved toward the front face to press the guide portion 173 projecting on the rear side of the connection unit 201. Consequently, the atmosphere communicating hole 179 and the ink supply port 178 of the ink cartridge 170' are disengaged from the connection unit 201. In this state, if the cartridge 170' is pulled out by holding the grip portion 175*a* with a finger, the cartridge 170 can be extracted from the connection unit 201. Since all the valve members 188, 196, 207, and 208 are in the closed valve condition, it is possible to prevent the ink of the ink cartridge 170 from leaking through the ink supply port 178 and the ink solvent of the connection unit 201 from evaporating, in extracting the ink cartridge.

In this state, if a new ink cartridge 170 is pushed through the window 253 rearward, the atmosphere communicating hole 179 and the ink supply port 178 of the ink cartridge 170 are fitted to the tubular atmosphere communicating port 205 and the ink supply port 204 of the connection unit 201. Consequently, the valve members 198, 188, 208, 207 of the openings or ports 179, 178, 205, 204 are retracted mutually and opened, so that an upper section of the ink storing chamber 177 in the ink cartridge and an upper section of the ink chamber 202 in the connection unit 201 are opened via the capillary narrow groove 180 to the atmosphere, and the ink in the ink cartridge 170 flows into the connection unit 201.

In this example, the ink cartridge can be inserted or extracted by moving the cartridge horizontally, but if the cartridge is moved in a direction nonparallel to the movement direction of the carriage, for example, in a vertical direction, the carriage can be prevented from moving upon the insertion or extraction operation. Accordingly, the inserting or extracting direction can be appropriately selected depending on the case structure or the like.

In the above example, the window 253 for inserting or extracting the cartridge is formed on the case main body. However, the lid 252 may be formed with the window 253 to exhibit the same effect because the lid is unnecessary to open in replacing the ink cartridge.

Further, in the above example, the cartridge is inserted or extracted by the manual operation, but an electromagnetic driving system such as an electromagnetic solenoid may be used to exhibit the same effect.

What is claimed is:

1. An ink cartridge, comprising:

a frame wall defining both a valve chamber having an open end and an ink reservoir, the valve chamber being in fluid communication with an interior of the ink reservoir, the frame wall having an open front surface;

a membrane valve disposed within the valve chamber;

a lid located at the open end of the valve chamber; and a film affixed to the wall to close the open front surface and hold the lid in place relative to the wall.

2. An ink cartridge, comprising:

a frame wall defining both a valve chamber having an open end and an ink reservoir, the valve chamber being in fluid communication with an interior of the ink reservoir, the frame wall having an open front surface;

a membrane valve disposed within the valve chamber;

a lid located at the open end of the valve chamber, the lid having an opening communicating with the valve chamber and a groove communicating with the opening; and a film affixed to the wall to close the open front surface, hold the lid in place relative to the wall, and cover the opening and groove to form an ink flow passage.

3. An ink cartridge as in claim 2, wherein the lid is at a position downstream from the membrane valve.

4. An ink cartridge, comprising:

an ink supply port;

a frame having a back surface with an inner surface and an outer surface, a first groove formed in the outer surface at a position upstream of the ink supply port, and a perimeter wall together defining both a valve chamber having an open end and an ink reservoir, the valve chamber being in fluid communication with an interior of the ink reservoir and the valve chamber being in fluid communication with the ink supply port through the first groove;

a membrane valve disposed within the valve chamber;

a lid located at the open end of the valve chamber, the lid having an opening communicating with the valve chamber and a second groove communicating with the opening, the second groove being located upstream of and in fluid communication with the first groove; and a film covering the second groove to define an ink flow passage.

5. An ink cartridge as in claim 4, wherein the lid is at a position downstream from the membrane valve.

6. An ink cartridge, comprising:

an ink supply port;

a frame having a back surface with an inner surface and an outer surface, a first groove formed in the outer surface at a position upstream of the ink supply port, and a perimeter wall together defining both a valve chamber having an open end and an ink reservoir, the valve chamber being in fluid communication with an interior of the ink reservoir and the valve chamber being in fluid communication with the ink supply port through the first groove;

a membrane valve, disposed within the valve chamber;

a lid located at the open end of the valve chamber, the lid having an opening communicating with the valve chamber and a second groove communicating with the opening, the second groove being located upstream of and in fluid communication with the first groove; and a film covering the opening and the first groove of the lid and fixing the lid in position.

7. An ink cartridge as in claim 6, wherein the lid is at a position downstream from the membrane valve.

8. An ink cartridge, comprising:

a reservoir body having an first face and a second face, a meandering first groove formed in the first face, a second groove formed in the second face, a recess positioned between and in fluid communication with both the first and second grooves, the recess having an opening in the first face and a frame having an opening therein leading to the first groove, and an interior of the reservoir body in fluid communication with the second groove;

a negative pressure generating system including a membrane valve, the negative pressure generating system being in fluid communication with the interior of the reservoir body, wherein a flow path exists from the interior along the second groove, through the recess, and to the first groove; and a film covering the opening of the recess and at least a portion of the first groove.

9. An ink cartridge according to claim 8, wherein the film also covers a portion of the frame to define a part of the reservoir body.

10. An ink cartridge according to claim 8, wherein the frame of the recess is located within the interior, and further comprising:

a smaller film of ink repellent and gas permeable material secured to the frame, the smaller film being secured to the frame so that the smaller film is located between the frame and the film and a gap exists between the smaller film and the film.

11. An ink cartridge, comprising:

a reservoir body having an first face and a second face, a meandering first groove formed in the first face, a second groove formed in the second face, a recess positioned between and in fluid communication with both the first and second grooves, the recess having an opening in the first face and a frame having an opening therein leading to the first groove, and an interior of the reservoir body in fluid communication with the second groove;

a negative pressure generating system in fluid communication with the interior of the reservoir body and including;

a frame wall defining a valve chamber having an open end;

a membrane valve disposed within the valve chamber;

a lid located at the open end of the valve chamber, the lid having an opening and an ink flow groove communicating with the opening, the ink flow groove being located downstream of and in fluid communication with the valve chamber;

an ink supply port located downstream of the ink flow groove; and a film attached to at least a portion of the first face, such that at least one of the first groove and the ink flow groove are covered by the film, wherein a flow path exists from the interior of the reservoir body along the second groove, through the recess, and to the first groove.

12. An ink cartridge according to claim 11, wherein the film also covers a portion of the frame to define a part of the reservoir body.

13. An ink cartridge according to claim 11, wherein the frame of the recess is located within the interior, and further comprising:

a smaller film of ink repellent and gas permeable material secured to the frame, the smaller film being secured to the frame so that the smaller film is located between the frame and the film and a gap exists between the smaller film and the film.

14. An ink supplying system according to claim 13, further comprising a film covering the capillary groove and also overlapping the air permeable film with a space between, the capillary groove being in fluid communication with the space.

15. An ink supplying system according to claim 14, wherein the film has different permeability properties than the air permeable film.

16. An ink supplying system for supplying ink to a recording head, the system comprising:

a recessed portion;

an air permeable film having an ink repellent property, and partitioning the recessed portion into first and second chambers;

an ink storing chamber communicated with the first chamber; and a capillary groove communicating the second chamber with the atmosphere.

17. The ink supplying system according to claim 16, further comprising:

a negative pressure generating system for supplying ink in the ink storing chamber to the recording head while maintaining a predetermined negative pressure.

* * * * *